US009457986B2

(12) United States Patent
Bisig et al.

(10) Patent No.: US 9,457,986 B2
(45) Date of Patent: Oct. 4, 2016

(54) CONTROL DEVICE FOR A HYDRAULIC ELEVATOR DRIVE

(76) Inventors: Roland Bisig, Einsiedeln (CH); Esad Ibrisimbegovic, Steinhausen (CH)

( * ) Notice: Subject to any disclaimer, the term of this patent is extended or adjusted under 35 U.S.C. 154(b) by 418 days.

(21) Appl. No.: 14/236,865

(22) PCT Filed: Aug. 4, 2011

(86) PCT No.: PCT/EP2011/003910

§ 371 (c)(1),
(2), (4) Date: Feb. 3, 2014

(87) PCT Pub. No.: WO2013/017141

PCT Pub. Date: Feb. 7, 2013

(65) Prior Publication Data

US 2014/0158469 A1 Jun. 12, 2014

(51) Int. Cl.
*B66B 1/28* (2006.01)
*B66B 1/30* (2006.01)
(Continued)

(52) U.S. Cl.
CPC . *B66B 1/30* (2013.01); *B66B 1/24* (2013.01); *B66B 9/04* (2013.01); *F15B 11/044* (2013.01); *F15B 11/0423* (2013.01); *F15B 2211/30505* (2013.01); *F15B 2211/30565* (2013.01);
(Continued)

(58) Field of Classification Search
CPC ..... B66B 1/30; B66B 1/24; B66B 9/04; F15B 11/0243; F15B 11/044; F15B 2211/30505; F15B 2211/30565; F15B 2211/31511; F15B 2211/31558; F15B 2211/329; F15B 2211/6326; F15B 2211/6654; F15B 2211/7052; F15B 2211/761
USPC ..... 187/247, 272, 273, 275, 277, 285, 391, 187/393; 91/42, 44, 360, 361, 363 A, 364, 91/365, 461; 417/3, 4, 5, 20, 21, 26, 280, 417/300
See application file for complete search history.

(56) References Cited

U.S. PATENT DOCUMENTS 4,205,529 A * 6/1980 Ko ..... F24F 3/1417 62/235.1
4,205,592 A 6/1980 Haussler
4,381,699 A 5/1983 Haussler
4,548,296 A 10/1985 Hasegawa
4,757,879 A * 7/1988 Rita ..... B66B 1/405 187/275
4,807,724 A * 2/1989 Martin ..... B66B 9/04 187/272
(Continued)

FOREIGN PATENT DOCUMENTS

DE 39 10 895 A1 10/1990

OTHER PUBLICATIONS

PCT/EP2011/003910 (filed Aug. 4, 2011) International Search Report dated Mar. 15, 2012.

*Primary Examiner* — Anthony Salata
(74) *Attorney, Agent, or Firm* — Fay Sharpe LLP

(57) ABSTRACT

A control device (1) for a hydraulic elevator drive (11) with a first and second control valve (21, 22) for controlling the volume flow of a working fluid wherein the flow is detected (610) and compared (52) with a reference value (51) and a pilot (3) with a first and second pilot valve (31, 32) to control the first and second control valve in which the pilot has an actuator (4) and a coupler (33) that can activate and decouple each pilot valve. A hydraulic drive system (16) for an elevator having the control device and a method for retrofitting such a drive system. The control device is simple in design and operation and provides for cost advantages and an increased reliability. The hydraulic drive system with the control device permits an overall improvement in the starting quality of an elevator by automatic compensation of drive-side and output-side interference variables and load-induced fluctuations in the working fluid pressure.

19 Claims, 7 Drawing Sheets

(51) Int. Cl.

| | |
|---|---|
| ***B66B 1/24*** | (2006.01) |
| ***F15B 11/042*** | (2006.01) |
| ***F15B 11/044*** | (2006.01) |
| ***B66B 9/04*** | (2006.01) |

(52) U.S. Cl.

CPC ..... *F15B2211/31511* (2013.01); *F15B 2211/31558* (2013.01); *F15B 2211/329* (2013.01); *F15B 2211/6326* (2013.01); *F15B 2211/6654* (2013.01); *F15B 2211/7052* (2013.01); *F15B 2211/761* (2013.01)

(56) References Cited

U.S. PATENT DOCUMENTS

| | | | | | |
|---|---|---|---|---|---|
| 5,046,310 | A | | 9/1991 | Kauss | |
| 5,131,507 | A | * | 7/1992 | Watanabe | B66B 1/30 187/285 |
| 5,864,101 | A | * | 1/1999 | Nishizawa | B60P 1/4471 187/222 |
| 5,969,302 | A | * | 10/1999 | Nishizawa | B60P 1/4471 187/240 |
| 2015/0014099 | A1 | * | 1/2015 | Celik | B66B 1/24 187/275 |

* cited by examiner

CONTROL DEVICE FOR A HYDRAULIC ELEVATOR DRIVE

FIELD OF THE INVENTION

The invention relates to a control device for a hydraulic drive, or rather, for a working fluid of a hydraulic drive, such as is particularly used in hydraulic drive systems for elevators, and enables control of the working fluid with regard to direction and volume in accordance with a presettable volume flow reference value. Furthermore, the invention relates to a hydraulic drive system for an elevator and a method for retrofitting such a drive with the control device according to the invention.

BACKGROUND OF THE INVENTION

In hydraulic drives, the driving power is known to be controlled by the pressure and the flow velocity of a working fluid conducted in a circuit from a reservoir, usually formed as an oil pan, via the pressure side of a motor-driven pump to a hydraulic consumer and from the low-pressure side of the latter back to the reservoir. To conduct the working fluid in this cycle, hydraulic power conduits are provided in flow connection between each of said driving components. The pump is typically a hydraulic pump with constant or variable delivery volume, i.e. a screw pump or a radial piston pump, which is driven by an electric motor. Consumers to be used are hydraulic motors for generating a translatory or rotatory output movement; the former may be configured as hydraulic cylinders, the latter as gear motors. The working fluids used are usually fluids on the basis of mineral oil, so-called hydraulic oils, synthetic fluids, or fluids on the basis of plants, wherein the latter particularly stand out due to its environmental compatibility. These working fluids can contain additives that permit a selective influencing of individual characteristics, such as the thermal characteristic, the aging resistance, or the corrosiveness.

Hydraulic drives are characterized by its high power density, its high efficiency, and its simple continuous controllability of the output motion with a high positioning accuracy, and are used in both vehicles and stationary equipment. The hydraulic power conduits for conducting the working fluid both between the pressure side of the hydraulic pump and the pressure side of the hydraulic motor and also between the return side of the latter and the reservoir are made in a flexible and/or rigid design so that the volume flow of the working fluid is also transferable over greater distances without significant additional mechanical effort and with the possibility of a separate arrangement of the drive side and the driven side of the hydraulic drive, or rather, of the motor-driven pump and the consumer. Thereby, hydraulic drives can be largely adapted without any difficulty to almost all space requirements at low space consumption. This proves particularly advantageous when such a drive is used in a hydraulic drive system for an elevator insofar as the prime mover does not necessarily need to be arranged in the elevator shaft together with the hydraulic consumer, or hydraulic jack, but, where applicable, can be arranged remote from there too. In this respect, the hydraulic drive also can be described as a hydrostatic transmission comprising a hydraulic pump, a hydraulic motor, and a reservoir with the working fluid, and the flow connections provided between these elements for conducting the working fluid in a closed or open circuit. As flow connections, or rather, tubing connections for conducting the working fluid within such a hydraulic system, all flow connections known to be suitable as flow connections in such a hydraulic system may in principle be considered, i.e. both rigid tubing elements, such as tubes or recesses in a housing of a particular element of the system, and flexible tubing elements, such as hoses.

A hydraulic drive system comprises, in addition to the hydraulic drive, any other devices for a failure-free operation, such as devices for filtering and/or draining of the working fluid, and safety devices, such as pressure relief valves, a control device for the continuous or discontinuous control of the volume flow of the working fluid from the hydraulic pump to the hydraulic motor and from the latter back to the reservoir. The control device is connected by hydraulic control conduits to the hydraulic power conduits in such a way that the working fluid is controllable by the control device with regard to direction and volume to and from the hydraulic consumer, or rather, hydraulic motor without conveying direction reversal of the pump, in fact in a way that the volume flow of the working fluid toward the hydraulic consumer allows a continuous output movement in a first direction and from the hydraulic consumer off a corresponding output movement in a second direction. As the hydraulic power conduits, the hydraulic control conduits are made in a flexible and/or rigid design in a customary manner and differ in this respect from the former essentially by their smaller cross section only.

In the case of approximately constant output loads, the compressibility of the working fluid in hydraulic drive systems is negligible. With strongly varying loads acting on the hydraulic consumer, however, as is the case in a hydraulic drive system for an elevator, fluctuations with regard to pressure and output movement may occur owing to the elasticity of volume of the working fluid, whereby the desired consistency of the output movement, or rather, output speed and force no longer is reliable. By strong operational heating of the working fluid, changes in viscosity in the working fluid may occur in addition, having similar adverse effects on the operating characteristics of the hydraulic drive system. In particular, the desired continuity of the output movement of the hydraulic consumer may also be adversely affected by pump-induced fluctuations of the volume flow of the working fluid.

A control device for controlling the speed of a hydraulic motor of the type having features of the invention describes CH-A5-629 877. Thereafter, the speed of the motor is detectable via the flow of oil in the motor inlet by a suitable flow meter and convertible into an electrical signal, which can be supplied to a comparator for forming a control signal as a function of a target value signal to be preset for a control valve arranged in each the inlet and the outlet of the motor. For actuating the valve, an electro-magnetic transducer is provided in each case in the form of an electrovalve in electrical connection with the comparator. In this respect, the components mentioned represent a control circuit which is capable of effectively compensating for deviations from the target value. The known control device thus allows presetting of selected motor speeds and an effective correction of parasitic drags, such as fluctuations of pump pressure and load.

Indeed it is possible with such a control to overcome the aforementioned drawbacks of a hydraulic drive system. Nonetheless, the latter has also disadvantages. Thus, it notably is disadvantageous that for the actuation of the two control valves in each case a separate electric actuator in the form of an electro-magnetic transducer in each case coupled to a particular pilot valve in each case is required, in order to ensure the desired direction-dependent control of the volume flow of the working fluid in the connection line on the high-pressure and low-pressure side of the hydraulic consumer, and thereby the correction of parasitic drags. The use of two electric actuators, however, is not only reflected in the manufacturing and the operating costs of such a control device, but also accounts for an increased risk of default, which in turn reduces the reliability of the hydraulic drive system as a whole.

SUMMARY OF THE INVENTION

It is therefore the object of the invention to provide a control device for a hydraulic drive that overcomes the disadvantages of the prior art, which is therefore suitable in a hydraulic drive system at variably adjustable drive speeds to correct effectively the impact of strongly varying output loads, temperature-induced fluctuations in viscosity and/or density, and pump-induced volume flow-variations of the working fluid to the desired consistency of the output movement, or rather, output speed and force of the hydraulic consumer and has, in addition, particularly a simpler construction and functioning, is more cost-efficient in production and operation, and is suitable in a hydraulic drive system for improving the reliability of the latter by a lower risk of failure. It is also part of the object of the invention to provide a hydraulic drive system for an elevator having the inventive control device. Finally, it is part of the object of the invention to provide a method for retrofitting a hydraulic drive system for an elevator with such a control device.

This object is achieved in that in a control device for a working fluid for the operation of a hydraulic drive according to the invention are provided, a flow path for conducting a volume flow of the working fluid in a first and in a second direction, a first and second control valve for controlling the volume flow in the flow path, a flow measuring means for detecting the volume flow in the flow path, a comparing means for comparing the detected volume flow with a presettable volume flow reference value, and a pilot control means for actuating the first and second pilot valve, wherein the flow path, the flow measuring means, the comparing means, the pilot control means, and the first, and second control valve form a control loop for maintaining the volume flow of the working fluid in the flow path as a function of the volume flow reference value, and the pilot control means has a first and second pilot valve for controlling the first and second control valve, and the control device is characterized in that the pilot control means comprises an electric actuating means for actuating the first and second pilot valve and a coupling means for coupling the first and second pilot valve, wherein the coupling means is formed with a coupling region for moving to and fro between a first and a second position, wherein in the first position the first and second pilot valve are coupled via the coupling region and are jointly actuatable by the electric actuating means to allow the volume flow of the working fluid in the flow path in the second direction via the second control valve, whereas in the second position of the coupling region of the coupling means the first and second pilot valve are decoupled and the first pilot valve only is actuatable by the electric actuating means to allow the volume flow of the working fluid in the flow path in the first direction via the first control valve.

Through the inventive design of the control device with two pilot valves and a coupling means having a coupling region, which couples the two pilot valves in its first position to allow a common actuation by an electric actuator and in this way to unblock the flow path for the working fluid in the second direction—preferably from a hydraulic consumer to a reservoir in a hydraulic drive system—via the second control valve, whereas in the second position of the coupling region of the coupling means the two valves are decoupled from one another and the electric actuator is able to actuate the first pilot valve only so that the flow path for the working fluid is unblocked in the first direction—preferably from the reservoir to the hydraulic consumer in the hydraulic drive system—via the first control valve, structure and functioning of the control device are considerably simplified in contrast to the prior art. The structural simplification results directly from the fact that for directional control and speed control of the volume flow of the working fluid only a single electric actuating means is required in addition to a simple and inexpensive coupling means, which in turn comes along with a simplification in terms of function, or rather, control technique specifically insofar as for the actuation of the two pilot valves a mere toggling between a coupling and a decoupling position of the coupling region of the coupling means is needed.

But the structural and the functional simplification are also directly reflected advantageously in the costs for the control device and in the reliability of the latter. The coupling means which is provided in accordance with the invention instead of a second electric actuating means can be manufactured in a comparatively very cost-efficient way from only a few simple and robust mechanical parts and allows thereby and through its function limited to only two defined switch positions a maintenance-free operation over the full life of the control device. The control device according to the invention thus may not only be manufactured and operated in a more cost-efficient way, but also has a higher overall reliability in addition. In a hydraulic drive system with the control device according to the invention, the advantages mentioned particularly contribute to a reduction in operation and maintenance costs and to an increase of system reliability. In that regard, it is advantageous to retrofit also hydraulic drive systems already in use with the inventive control device, does it make possible thus even to exceed enhanced security requirements as they particularly also apply to elevator systems.

The requirements in terms of compliance with the variably adjustable output speeds, or rather, speed limits for the output movement of the hydraulic consumer in response to changes in the output load, temperature-induced changes in the viscosity, density, and/or in the volume flow of the working fluid generated by the pump—in other words, the continuity requirements regarding the output movement, or rather, output speed and output force of the hydraulic consumer—are fulfilled by the inventive control device primarily through a continuous comparison of the actual and the reference value of the volume flow of the working fluid in the pressure side inlet or in the discharge of the hydraulic consumer in the manner known in principle from CH-A5-629 877, wherein, however, merely a single electric actuating means and a simple coupling means are required for correcting said disturbances, instead of the two electric actuators disclosed there. In this respect, the invention provides an advantageous further embodiment of said known control device. In particular for applications with only minor requirements on stability and positioning accuracy of the output movement, the control device may in principle be provided even without control loop, thus without the flow measuring means for detecting the current actual value of the volume flow and the formation of the difference signal from the actual and the reference value of the volume flow of the working fluid as correcting variable of the control loop. In such an otherwise unmodified control device, the electric actuating means, and thereby each or only the first pilot valve, is activated directly proportional to the reference value. This control can be carried out, for example, after a defined time pattern and may be additionally corrected with pressure and/or temperature information.

An integral part of the solution of the problem of the invention is also a hydraulic drive system for an elevator, comprising a reservoir with a working fluid, a motor-driven pump, a hydraulic consumer, a control device, and conduit means provided between the reservoir, the control device, and the hydraulic consumer in a way that the working fluid can be conducted from the reservoir via the pump and the control device to the hydraulic consumer and from this back via the control device to the reservoir, wherein the hydraulic drive system being characterized in that the control device is configured according to the invention, thus in particular has a single electric actuating means and a coupling means with a coupling region movable to and fro for actuating the pilot valves to control the volume flow in the flow path to and from the hydraulic consumer.

A further integral part of the solution of the problem of the invention is finally a method for retrofitting a hydraulic drive system for an elevator which has a reservoir with a working fluid, a motor-driven pump, a hydraulic consumer, a control device, and conduit means provided between the reservoir, the control device, and the hydraulic consumer in a way that the working fluid can be conducted from the reservoir via the pump and the control device to the hydraulic consumer and from this back via the control device to the reservoir, wherein the control device has a flow path for conducting a volume flow of the working fluid in a first and in a second direction, a first and second control valve for controlling the volume flow in the flow path, a flow measuring means for detecting the volume flow in the flow path, a comparing means for comparing the detected volume flow with a presettable volume flow reference value, and a pilot control means for actuating the first and second control valve, wherein said flow path, said flow measuring means, said comparing means, said pilot control means, and said first, and second control valve form a control loop for maintaining the volume flow of the working fluid in the flow path as a function of the volume flow reference value, and the pilot control means comprises a first and second pilot valve for controlling the first and second control valve, and further comprises a first electric actuating means for actuating the first and a second electric actuating means for actuating the second pilot valve.

The inventive retrofitting method is characterized by a process step where in the above specified hydraulic drive system for an elevator a coupling means for coupling the first and second pilot valve is installed, replacing the second electric actuating means for actuating the second pilot valve, wherein said coupling means has a coupling region configured for reciprocally moving between a first and a second position, wherein in the first position each pilot valve is coupled by the coupling region and can be actuated by the first electric actuating means so that the second control valve allows the volume flow of the working fluid in the flow path in the second direction, thus as preferred from a hydraulic consumer to a reservoir. If the coupling region of the coupling means takes its second position, however, the second pilot valve is decoupled from the first pilot valve so that only the first pilot valve can be actuated by the first electric actuating means for unblocking the volume flow of the working fluid in the flow path in the first direction via the first control valve, thus as preferred from the reservoir to the hydraulic consumer.

The advantages that can be achieved with both the inventive hydraulic drive system for an elevator as well as with the inventive retrofitting method for such a drive system are directly resulting from the advantageous effects set forth above for the control device according to the invention. Advantageous embodiments of the invention are apparent from the dependent claims and will be explained more extensively below.

The coupling means, the first, and second pilot valve, and the electric actuating means are arranged as components of the pilot control means, or rather, servo control in the control device, wherein the coupling means comprises the movably supported coupling region. In its structural implementation, the coupling means, which can also be referred to as a coupling body, is mainly determined by the particular effective direction of the movements to be coupled and has in this respect to ensure, in addition to a sufficient mechanical stability over the expected useful life, essentially a defined temporary interaction via its coupling region with the two pilot valves to be coupled. This coupling region may be comprised in different coupling means made of different materials and having different surface properties. In either case, the coupling region is in relation to the two pilot valves movably arranged in such a way that an actuation of the first pilot valve from the close-position to the open-position—or vice versa—is transmittable through the coupling region to the second pilot valve so that the actuation of the latter between the close-position and the open-position can be synchronized with a corresponding actuation of the first pilot valve. The electric actuating means is configured for direct co-operation with said first pilot valve.

In order to move the coupling region of the coupling means from its first position to its second position in which the two pilot valves are no longer coupled, and thus the electric actuating means only can actuate the first pilot valve, an impact momentum is required which is applied by an impulse generating means. As such, in principle all actuating means are eligible which are capable to provide the mechanical energy necessary for the change of position as kinetic energy, such as a spring or an electromagnetic transducer. Irrespective of the type of impulse generating means ultimately used, in any case an impulse guiding means for defined alignment, or rather, guiding of the impact momentum on the coupling means generated by the impulse generating means is provided. This impulse guiding means has a first and a second end and is configured so that an impact momentum generated by the impulse generating means is largely lossless guidable from the first via the second end to the coupling means. Such a suitable impulse guiding means is insofar, for example, a hydraulic conduit means with its inlet and its outlet provided in the form of a tube supplying a fluid as impulse generating means and, therefore, a pressure pulse conveyed by it as an impact momentum to the coupling means in such a way that the increase of pressure in the fluid at the outlet of the tube, i.e. at the second end of the impulse guiding means, enables a desired displacement of the coupling region of the coupling means. Generally, the impulse guiding means is always adapted to the impulse generating means in such a way that an impact momentum generated by the impulse generating means ensures a reliable release of the coupling region of the coupling means from each pilot valve and a defined movement of the coupling region of the coupling means from its first to its second position.

In addition to a direct transmission of the impact momentum with the impulse generating means guided by the impulse guiding means directly acting on the coupling means, also an indirect or mediated impact momentum transmission between the impulse generating means and the coupling region of the coupling means from the first via the second end of the impulse guiding means can be advantageous from case to case. As impulse transmission means, preferably movably guided rigid bodies, or rather, plungers are used, but without basically ruling out other means of transmission, such as fluids. The impulse guiding means also is adapted in a suitable manner to the particular impulse transmission means so that this alternative embodiment of the invention ensures a reliable releasing of the coupling region of the coupling means from each pilot valve and its defined movement from the first to the second position too. As plunger material may be used any material suitable for hydraulic applications which has the necessary mechanical rigidity. Preferably, the plunger is made of metal, such as steel.

This alternative embodiment is particularly advantageous, when use is made of commercially available components in the realization of the displacement function. Such transmission means comprise in a structural unit usually, in addition to a standardized connector for the impulse generating means, a mostly one-part plunger movable to and fro along its longitudinal axis with its ends each formed in an appropriate manner for the application of force, or exertion of force, a guiding means with a first and a second end for slidably co-operating with the plunger in its reciprocating movement between the two ends, and a resetting means for biasing the plunger into its rest position. The guiding means is generally formed as a cup-shaped guide bushing in which the plunger is mounted displaceably against a helical compression spring.

In view of the purpose of the inventive control device, namely the control of a working fluid for the operation of a hydraulic drive, it is especially preferred to utilize the working fluid for the hydraulic drive as the impulse generating means, which, by an appropriate dimensioning of the retaining forces of the coupling means and the retaining means of the first control valve, initially moves the coupling means from its first to its second position when starting the pump before it overcomes the retaining force of the retaining means of the first control valve and the piston, or rather, shut-off body of the latter is moved from the close-position in which the valve inlet opening is closed by the piston to the open-position in which the valve inlet opening is open. For this, the impulse transmission means specified above is configured as a hydro-mechanical transmission means with a working fluid port, and a hydraulic indirectly acting plunger, and connected via a hydraulic control conduit to the flow path of the working fluid in such a way that its actuation is effected on reaching a defined working fluid pressure in the flow path for reliably detaching the coupling region of the coupling means from each pilot valve and to allow its defined movement from the first to the second position. The working fluid port is in this case provided at the first end of an impulse guiding means configured in the form of the cupular guide bushing. In other words, the impact momentum required for actuation of the coupling means is generated by the volume flow of the working fluid provided for the operation of the hydraulic drive. Depending on the control concept chosen in each case, this can be done, for example, by switching on and off the motor-driven pump or by opening and closing an additional shut-off means in the flow connection between pump and coupling means. It is preferred, however, to provide for it a bypass valve controllable via a valve control port, or rather, a valve control opening in the inventive control device, which facilitates in its open-position a feedback of the working fluid conveyed by the pump to the reservoir and in its close-position a pressure increase of the working fluid, or rather, an impact momentum in the flow path allowing in turn to move the coupling means from its first to its second position. The hydro-mechanical transmission means is set such that the coupling region of the coupling means is movable by the plunger almost without any delay from the first to the second position.

The control concept based on the direct connection of the pump and the coupling means according to the invention is applicable to the best advantage particularly in a drive system for a hydraulic elevator facility, since in this case no additional control effort is required. In a hydraulic elevator, the hydraulic motor, which in this case is configured as a single- or multi-stage, direct or indirect lifter, or rather, hydraulic cylinder being coupled with a movable platform, particularly a cabin or a car for passenger transport, is only driven by the pump during lifting, whereas lowering is effected by discharging the working fluid from the hydraulic motor and therefore solely by the prevailing weight. To control the volume flow of the working fluid in the flow path to and from the hydraulic motor in a hydraulic elevator, it is therefore sufficient if the control device, or rather, the coupling means comprised in it has an appropriate flow connection with the pump. Thereby, the control device according to the invention is characterized with regard to the feed forward control not only by simple mechanical components, but in particular also by a significantly reduced control expense compared to the prior art. Although it is preferred in the inventive control device to use the working fluid itself as impulse generating means, there are notwithstanding control concepts conceivable in which other, functionally equivalent, impulse generating means can be of particular advantage for generating an impact momentum, such as electromagnetic actuators in conjunction with the corresponding electrical drive means.

The coupling region of the coupling means is provided as a convex surface as preferred according to the invention, particularly in the form of the surface of a spherical coupling means, or rather, coupling body to largely minimize friction losses when contacting the pilot valves and, if applicable, an impulse transmission means, or rather, plunger during actuation. In this respect, it is preferred to utilize a steel ball as coupling means, the surface of which comprises the coupling region; steel balls are commercially available in different, closely toleranced dimensions, and surface qualities, they withstand even high mechanical loads, are maintenance-free, and also inexpensive, and thereby fulfill perfectly all essential requirements on a coupling region. Occasionally, it may be preferable, however, to form the coupling region with a different topography, and/or of a different material, or a combination of different materials. Thus, the coupling region may be provided, for instance, in the form of a metallic coating, if applicable of different metals, on a base body made of plastic as a coupling means. In order to enable a change in direction of an actuation to be transmitted by the coupling region, the coupling region can be provided for example in the form of a lateral face of a prismatic coupling body.

Finally, it may be desirable to assist resetting of the coupling region from its second to its first position. For this purpose, a suitable resetting means, preferably a spring, is arranged in the pilot control means in such a way that the retaining force of the resetting means, or rather, biasing force of the spring counteracts the impact momentum of the impulse generating means so that a safe resetting of the coupling region of the coupling means to the first position reliably is made sure on a decrease of the application of force by the impulse generating means; the resetting means defines in this respect the rest position, or rather, initial position of the coupling region of the coupling means. This, in combination with the aforementioned hydro-mechanical impulse transmission means and an appropriate dimensioning of the two resetting means, or rather, springs results in the advantage of a co-operation free from backlash between plunger and coupling means.

With the inventive control device it is thus possible in an equally advantageous and surprising way to ensure the functionality of the known control device by just a single electric actuating means, or actuator, at the same time reducing the risk of default. As an electric actuating means for actuating the first and second pilot valve, preferably an electro-magnetic actuator is provided. Alternatively, also a stepping motor or a piezoelectric actuator may be preferred for this purpose, without to exclude, however, other functionally equivalent transmission means in principle. In this respect, the feature electric actuating means within the meaning of the invention comprises all electromechanical actuators which can convert electrical energy into the mechanical energy required to actuate a hydraulic valve.

Both control valves co-operating in the control device according to the invention with the pilot control means for controlling the volume flow of the working fluid in the flow path in the first and second direction, i.e. to and from the hydraulic consumer, can in principle be formed in any commercially available and for the intended use in an elevator control suitable design; such valves typically have a one-piece or multi-piece piston movably mounted between an open- and close-position in a guide means which is formed for example as a recess in a metallic valve block or as a separate bushing-shaped or cupular housing each with the required valve openings. However, it is particularly advantageous to form the two control valves and their flow connections within the control device in the preferred manner described below according to claims 7 to 15, in order to achieve an even further improvement of the control device specified in claims 1 to 6 as compared to the known control device. In this way, not only substantial further cost savings are possible. Rather, also functional improvements are associated therewith directly contributing to an even further increased reliability of the control device, and—in the case of a hydraulic drive system—to a further reduction in operating, and maintenance costs, and to a further increase in the system reliability. These benefits directly result from the following explanations of the other preferred embodiments of the invention.

In the known manner, each of the first and second control valve for controlling the volume flow of the working fluid in the flow path comprises a valve inlet opening, a valve outlet opening, and a valve control opening in flow connection with the flow path, a shut-off body, or piston, movable to and fro between an open- and close-position of the valve so that a continuous transition between the two positions is enabled, a guide means, or rather, a bushing for slidably guiding the shut-off body, and a retaining means, or rather, tensioning means, preferably a compression spring, which biases the shut-off body alternatively in the open-position or close-position of the control valve, i.e. exerts a retaining force on it in the respective direction, and in this respect holds it in the particular position. The valve design according to the invention differs from the design of known valves in that each of the guide means and the shut-off body has a plurality of corresponding, or rather, geometrically matching regions for sliding co-operation during the reciprocating movement of the shut-off body. Preferably, the guide means in all comprises three guide means parts of different structural design in sequential arrangement and in permanent joint each namely a first guide means part with a first guide means region, a second guide means part with a second guide means region, and a third guide means part with a third guide means region. Each of these guide means regions is formed in a corresponding manner with the shut-off body so that the latter is movable to and fro between the open- and close-position of the control valve along its longitudinal extension, or rather, along the longitudinal axis of the valve relative to the guide means and is co-operating at least with each of the first and second guide means region in a sliding manner. In the close-position of the respective control valve, the shut-off body and the third guide means region are in addition interacting in a sealing manner.

The guide means preferably comprises for this purpose in its first and third guide means part a bushing in each case for the axially displaceable mounting of the shut-off body; in this respect, the first guide means region is formed by the wall of the bushing provided as the first guide means part facing the shut-off body, the third guide means region by the corresponding wall of the bushing provided as the third guide means part and encloses the shut-off body in each case in its particular corresponding region. The second guide means part comprises a plurality of pins, preferably three cylinder pins, that extend between the first and third guide means part in parallel alignment with the longitudinal axis of the valve and enclose the shut-off body preferably equidistantly spaced from each other in such a way that they can guide the latter in sliding co-operation at its reciprocating movement between the open- and close-position of the valve. Each pin is in each case permanently fixed with its first end to the first guide means part and with its second end to the third guide means part in a way that the second guide means region comprises a part of the lateral area of at least one of the pins. If the pins in question are cylinder pins as preferred and the shut-off body in question is a rotational solid as preferred, the second guide means region may hence be limited by an appropriate spacing of the pins from the shut-off body as far as to the contact line between the at least one pin and the shut-off body; if a line contact takes place under application of a force the resulting thrust face is known to be rectangular. It is preferred, however, that all pins can co-operate with the shut-off body in a sliding manner, so that the second guide means region comprises the contact lines of all pins with the shut-off body. Thus, the first and the third guide means part along with the second guide means part comprising all of the pins constitute a functional unit and consequently the guide means. In the inventive embodiment of the first and second control valve, the valve control opening is in each case comprised in the first guide means part, whereas the valve outlet opening of the first control valve and the valve inlet opening of the second control valve are associated with the second guide means part, and the valve inlet opening of the first control valve and the valve outlet opening of the second control valve with the third guide means part.

Through the realization of the second guide means part with pins and the substantial reduction in the contact area between the guide means and the shut-off body involved without additional production expenditure, the static and dynamic friction occurring during valve actuating can significantly and specifically be reduced in an extremely cost-effective way. This reduction of frictional losses directly causes an improved switching reliability and an extension of the service life of the control valve constructed in accordance with the invention and leads in a hydraulic drive system to a reduction of maintenance costs and to a stabilization of the output motion. Solely by the preferred utilization of standard pins which are available for that use in a good selection in nearly all eligible materials, finishes, dimensions, and tolerances as inexpensive semi-finished products and the considerable material savings in the manufacture of the guide means compared with conventional bushings going along with it, production costs of the inventive control valve are, in addition, well below those of a conventional valve. Moreover, the utilization of such pins has the beneficial effect that the required dimensional tolerances for the guide means basically can be met by an exact alignment of the first and third guide means part, hence can be ensured without difficulty by an exact positioning of the holes for receiving the pins in the respective region.

Particularly in view of a simple and economic mounting of the inventive control valve, the guide means is designed to co-operate with the shut-off body and the retaining means in such a way that its inner diameter, or rather, its effective opening width steadily decreases from the first via the second to the third guide means part so that the opening width of the guide means in the first guide means part is greater than in the second guide means part and in the second guide means part is greater than in the third guide means part. Alternatively, the opening width also may increase from the first via the second to the third guide means part in a corresponding manner. The valve function is ensured insofar as also the shut-off body is formed with appropriate, corresponding shut-off body regions, i.e. comprises a first, second, and third shut-off body region with the particular effective outer diameter being matched to the corresponding opening width of said first, second, and third guide means part. The valve assembly, or rather, the insertion of the shut-off body and the retaining means in the guide means thereby is possible in each case from the guide means part with the greatest opening width. In this way, the relative movability of the shut-off body between the open- and close-position of the particular control valve in relation to the particular guide means is limited by the third and first guide means part respectively.

It is advantageous and particularly preferred to configure the third guide means part in its region adjacent to the second guide means part with a plurality of recesses. These recesses are oriented relative to the longitudinal axis of the valve and may be tapered in the direction of closing of the particular control valve. By way of example these recesses are formed U-shaped, V-shaped, and/or Y-shaped. Additionally or alternatively, it is preferred to form the third guide means part in its region adjacent to the second guide means part with a bevel so that the third guide means region is tapered like a funnel in the direction of closing of the particular control valve. Through these recesses and/or the bevel within the third guide means part in its region adjacent to the second guide means part, a continuous change of the effective area of the valve opening, or rather, of the valve inlet opening of the first control valve and the valve outlet opening of the second control valve during the movement of the shut-off body within the third guide means part is made possible. For the control device according to the invention, this results in the largest possible stabilization of the flow conditions during actuation of the first and second control valve. Thus, the inventive control device having the two preferred control valves can make a significant contribution to the stabilization of the output movement in a hydraulic drive system. Moreover, this preferred embodiment of the third guide means part of the first and second control valve causes a reduction of the flow noises during operation of the control device, which therefore has the further advantage of a lower noise emission too.

With regard to a simpler and less expensive production and maintenance of the inventive control valve it is further preferred to provide the sealing region of the particular control valve in its close-position, more precisely the third guide means part in its front end facing away from the second guide means part, as initially separately produced ring-shaped, preferably self-positioning, seal insert and to join this in the course of the valve assembly with the third guide means part, preferably by means of an O-ring, so that the ring-shaped seal insert and the third guide means part form a structural unit. The ring-shaped seal insert is designed to co-operate with the corresponding third shut-off body part of the shut-off body in such a manner that it merely contacts the third shut-off body region in the close-position of the control valve along a, preferably circular, contact line enclosing the valve opening in a sealing manner; specifically, the third guide means region does not serve, like the first and second guide means region of the guide means, to guide the shut-off body when moving to and fro between the close- and open-position of the control valve, but to ensure by means of the ring-shaped seal insert comprised therein a reliable closing of the control valve in co-operation with said third shut-off body region of the shut-off body.

In a preferred embodiment of the inventive control device, the shut-off body of the second control valve is formed in one piece with the first, second, and third shut-off body region and slidably disposed in the guide means with the corresponding first, second, and third guide means part in each case. The retaining means, which is preferably provided in the form of a spring, in particular a cylindrical compression spring, is arranged in such a way that its retaining force, or rather, spring force is acting via the third shut-off body region in the direction of the third guide means region of the third guide means part so that the second control valve is biased by the retaining means in the close-position of its valve outlet opening. The first shut-off body region is preferably provided with a blind bore for a defined application of the spring force to the shut-off body so that the spring is guided along the longitudinal axis of the valve. Alternatively, however, the retaining means also may act directly on the face of the first shut-off body region, wherein in this case a defined alignment between the two components is ensured preferably by suitable projections on the front face of the shut-off means. The valve of this design is provided in the inventive control device for controlling the volume flow of the working fluid in the second direction in the flow path. In the hydraulic drive system according to the invention it consequently controls as the second control valve the volume flow of the working fluid in the discharge of the hydraulic consumer.

In a further preferred embodiment of the inventive control device, the shut-off body of the second control valve is provided with a pistil-shaped projection at its end associated with the third guide means part. This pistil-shaped projection is formed in such a way that it can act in the manner of a baffle plate for a volume flow of the working fluid discharged from the second control valve, hence damps the volume flow of the working fluid that exits the third valve opening—the latter constitutes the valve outlet of the second control valve. Through the permanent joint of the pistil-shaped projection with the shut-off body, the kinetic energy of the working fluid which is released during attenuation acts back as actuating force on the shut-off body which thus can be moved to its close-position by the volume flow of the working fluid; in this respect, the actuating force generated through damping acts in the same direction as the retaining force of the retaining means by which the shut-off body of the second control valve is to be held in its close-position. This embodiment of the inventive control device has the advantage of an even more constant controllability of the volume flow of the working fluid. Although, in the control device according to the invention preferably only the second control valve is formed with the pistil-shaped projection, it may be equally advantageous in some applications to also provide the shut-off body of the first control valve in this shape; in principle, the pistil-shaped projection can be provided both on a one-part and on a multi-part shut-off body.

According to a further preferred embodiment of the control device to which the invention pertains, the shut-off body of the first control valve is in several parts, in particular two-part, in the form of a first and second shut-off body part. Here, the first shut-off body part comprises the first and an additional fourth shut-off body region and the second shut-off body part the second, and third, and an additional fifth shut-off body region. The fourth and fifth shut-off body region are mounted slidably interlocked in such a way that the length of the shut-off body is variable. In other words, the first and second shut-off body part of the first control valve are slidably supported against each other so that the overall length of the shut-off body is variable by telescoping the fourth to the fifth shut-off body region or vice versa. Thereby, the retaining means in the form of a spring, particularly a cylindrical compression spring as preferred, can co-operate with the shut-off body in a way that on the one hand the retaining force of the retaining means, or rather, the spring force is applied to the second part of the shut-off body via its third shut-off body region and on the other hand to the first part of the shut-off body via its first shut-off body region so that a reduction in length of the shut-off body is effected by a movement of the first shut-off body part, or of the second shut-off body part toward the other shut-off body part in each case, or of both shut-off body parts toward each other, and also of both shut-off body parts relative to the guide means at constant length of the shut-off body against the retaining force of the retaining means. If the first shut-off body part in the close-position of the control valve, in which the third shut-off body region of the second shut-off body part is in sealing contact with the third guide means region of the third guide means part, is charged with an actuating force in the direction of the second shut-off body part against the retaining force of the retaining means, this results thus in a reduction in the length of the shut-off body proportional to said actuating force. The maximum adjustability and therefore the minimal length of the shut-off body is reached when both shut-off body parts abut on each other; if the degree of overlap of the fourth shut-off body region of the first shut-off body part and the fifth shot-off body region of the second shut-off body part is 50% in the rest position of the retaining means, the resulting maximum adjustability is consequently half of the penetration depth of the fourth in the fifth shut-off body region or vice versa.

Such a bypass valve is provided in the inventive control device as the first control valve for controlling the volume flow of the working fluid in the flow path in the first direction. In the control device according to the invention, this first control valve allows the control of the volume flow of the working fluid in the inlet of the hydraulic consumer. Thereby, it has the additional important advantage that it enables an automatic bias adjustment under changing operating conditions, such as fluctuations of load and/or temperature within a hydraulic drive system, whereby a corresponding adjustment of the circulating pressure or pilot pressure of the working fluid in the hydraulic system becomes unnecessary.

A further particularly advantageous embodiment of the inventive control device with the bypass valve has, in particular in a hydraulic drive system for an elevator in addition to the above advantages, also the advantage that the switching, or rather, unblocking of the volume flow of the working fluid in the flow path in the first direction from a reservoir via a motor-driven pump to a hydraulic drive can also be effected without almost any time lag and substantially independent of the particular pay load of the elevator, that is with minimum and load-independent delay time. Accordingly, the control device in the embodiment as specified hereinafter enables over the prior art, in addition to the load-independent jerk-free start-up of the elevator car, also an equally load-independent start-up without substantial time delay, hence an even further improvement of the starting quality of the elevator. This further embodiment of the invention therefore additionally solves the partial problem of minimizing the undesirable time delay in the closure of the bypass valve irrespective of the load-dependent working fluid pressure prevailing in the flow path.

This partial problem is solved in that in the inventive control device the first control valve with a two-part shut-off body in accordance with the embodiment specified above is connected to the flow path in such a way that the flow connection exists between the valve inlet opening and the flow path for conducting the volume flow of the working fluid in the first direction, between the valve outlet opening and the flow path for conducting of the volume flow of the working fluid in the second direction, and between the valve control opening and the flow path for conducting the volume flow of the working fluid in the first and in the second direction. Specifically, the flow connection between the valve control opening of the first control valve and the flow path comprises in a parallel arrangement a throttle element for damping the volume flow of the working fluid from the valve control opening, a check valve for conducting the working fluid to the valve control opening, and a hydromechanical transmission means for mechanically moving the shut-off body at the valve control opening. Moreover, the valve control opening of the first control valve is connected via the throttle element with the pilot control means so that an increase of pressure in the working fluid at the valve control opening made possible through the pilot control means in the second position of its coupling means causes a volume flow of the working fluid in the flow path in the first direction by moving the shut-off body of the first control valve from its open- to its close-position.

This configuration of the flow connections of the first control valve in the inventive control device allows thus that the piston of the first control valve moves from its open-position to its close-position always at the time when the coupling means of the pilot valve takes up its second position; in the second position the two pilot valves are decoupled through the coupling means so that the first pilot valve is movable from its open-position to its close-position through its associated electric actuating means while the second pilot valve remains in its close-position by the retaining force of the associated mechanical actuating means. Accordingly, in the second position of the coupling means of the pilot control means the working fluid cannot flow off from the valve control opening of the second control valve via the pilot control means, causing a relative increase in pressure at the valve control opening of the first control valve which at sufficient working fluid pressure in the flow path for conducting the volume flow of the working fluid in the first direction—preferably from a reservoir to a hydraulic consumer—by a movement of the shut-off body of the first control valve from its open- to its close-position finally allows a volume flow of the working fluid in the flow path in the first direction. In the second position of the coupling means of the pilot control means, this movement of the shut-off body of the first control valve is directed opposite to the effective pressure of the working fluid at the valve inlet and the retaining force of the retaining means, which preferably comprises a compression spring.

The throttle element dampens the volume flow of the working fluid in the flow connection from the flow path to the valve control opening and vice versa, hence during closing and opening of the first control valve; a throttle element is generally used to prevent sudden opening and closing of a valve and thereby to stabilize, or rather, delay the valve movement at switching and with it of the volume flow of the working fluid being switched. This attenuation, or rather, delay through the throttle element, however, proves to be a disadvantage when a rapid closing of the valve is desired; typically, this switching delay is also referred to as the dead time, which in the case of the inventive control device is defined by the time duration between activation of the electric actuating means and the opening of the check valve in the flow path connected to the first control valve for conducting the volume flow of the working fluid in the first direction. Since the valve control opening of the first control valve in addition is connected with the pilot control means, more precisely the first pilot valve, which co-operates in turn via the throttle element and the second pilot valve with the flow path for conducting the volume flow of the working fluid in the second direction, the dead time is also depending on the working fluid pressure in the flow path and thus on the particular output load, or rather, pay load of an elevator controlled by the control device according to the invention. The throttle element provided between the valve control opening and the flow path for conducting the volume flow of the working fluid in the first direction via the throttle element prevents with the two-part shut-off body, or differential piston, therefore especially also undesirable transient changes in pressure and/or vibrations in the working fluid within the hydraulic line system as a result of opening the first control valve.

The minimization of the dead time during closing of the first control valve is primarily enabled by the hydro-mechanical transmission means for mechanically actuating the shut-off body at the valve control opening. The hydro-mechanical transmission means is provided in flow connection with the flow path for conducting the volume flow of the working fluid in the second direction and thus ensures a load-dependent mechanical pre-positioning of the shut-off body of the first control valve during operation of the control device; thereto, the hydro-mechanical transmission means is configured in a conventional manner with a hydraulically operated plunger for converting a hydraulic pressure signal into a proportional mechanical displacement signal. An increase of the working fluid pressure in the flow path for conducting the volume flow of the working fluid in the second direction with respect to the working fluid pressure in the flow path for conducting the volume flow of the working fluid in the first direction thus always results in an outward movement of the plunger. The plunger is mechanically coupled directly to the shut-off body, more precisely to its first shut-off body part, by an appropriate structural arrangement toward the valve control opening of the first control valve so that the outward movement of the plunger against the retaining force of the retaining means of the first control valve can move the first shut-off body part toward the second shut-off body part and therefore the entire shut-off body toward the valve inlet opening. This load-dependent pre-positioning of the shut-off body results in a shift in the operating point of the first control valve corresponding to the currently prevailing pressure conditions in the hydraulic conduit system of the inventive control device. In other words, by the load-pressure-dependent pre-positioning of the shut-off body of the first control valve the operating displacement of the latter is reduced up to the sealing abutment on the third guide means in the region of the valve inlet opening. Since, however, closing of the first control valve takes place through the working fluid itself, wherein due to the pressure prevailing in the flow path for conducting the working fluid in the first direction the working fluid in the second position of the coupling means with the first pilot valve of the pilot control means closed by the electric actuating means flows to the valve control opening and further into the first guide means part of the first control valve in order to cause the required displacement of the shut-off body there, also the volume of working fluid required for this is reduced in accordance with the load-pressure-dependent pre-positioning of the shut-off body so that even this results in a load-pressure-independent, or rather, load-pressure-compensated reduction of the delay time.

As stated above, the actuation of the shut-off body of the first control valve is hydraulically indirectly by the working fluid via the hydro-mechanical transmission means at the valve control opening of the first control valve at an increase of the working fluid pressure in the supply line to the transmission means, so without entry of working fluid into the first control valve. In order to exclude, especially in the event of transient pressure increases, the risk of adverse formation of a vacuum, or rather, negative pressure in the connecting region, more precisely in the first guide means part of the first control valve, and at the same time to further shorten the dead time, the first valve control opening is additionally connected to the flow path for conducting the volume flow of the working fluid in the first direction through the check valve. This check valve, which is preferably configured with a compression spring as actuating means, opens at a defined threshold in the feed direction of the working fluid toward the first valve control opening and blocks the working fluid flow in the opposite direction. Through the check valve a defined and largely delay-free flow of the working fluid into the first guide means part of the first control valve is possible that way, avoiding an undesirable vacuum formation or negative pressure; as is known vacuum formation or negative pressure inside a valve results in unstable switching behavior with undefined switch positions and should therefore be avoided. The inventive control device in this embodiment allows thus through a load-dependent pre-positioning of the shut-off body of the first control valve formed as a differential piston in connection with a reduction of the flow resistance in the inlet to its valve control opening also to minimize the time delay at closing of the first control valve, independent from the load-conditioned working fluid pressure prevailing in the flow path, hence an essentially load-independent and delay-free switching of the bypass valve from the open- to the close-position. In a hydraulic drive system for an elevator the inventive control device in this embodiment also allows a substantially delay-free and pay load-independent unblocking of the volume flow of the working fluid for a lifting motion of the elevator car, hence a faster start and consequently an enhancement of the start-up quality of the elevator.

The second control valve in the above-mentioned embodiment of the inventive control device is preferably formed with a one-piece shut-off body and is connected with the flow path through each of its valve inlet opening, valve outlet opening, and valve control opening. This connection is provided in detail between the valve inlet opening and the flow path for conducting the working fluid in the first and second direction, between the valve outlet opening and the flow path for conducting the working fluid in the second direction, and between the valve control opening and the flow path for conducting the working fluid in the first and second direction. The latter flow connection comprises a throttle element for damping of the volume flow of the working fluid. In addition, a further flow connection is provided inside the second control valve in the form of an annular gap between the valve inlet opening and a boundary surface of the one-piece shut-off body facing away from its end associated with the valve control opening so that a working fluid pressure acting via this flow connection and the valve inlet opening on the one hand and the valve control opening on the other hand onto the shut-off body can produce two oppositely acting actuating forces for moving the shut-off body between the close- and open-position of the second control valve. Furthermore, the valve control opening is connected to the pilot control means, more specifically, to the valve inlet opening of the second pilot valve comprised therein. This connection, preferably provided via the throttle element, ensures that the piston of the second control valve is movable from its close-position to its open-position always at the time when the coupling means of the pilot control means is in its first position; in the first position the two pilot valves are coupled by the coupling means so that the second pilot valve can be moved by the electric actuating means of the first pilot valve from its close- to its open-position. Accordingly, in the first position of the coupling means of the pilot control means the working fluid can flow off from the valve control opening of the second control valve through the pilot control means, which involves a pressure reduction at the valve control opening of the second control valve. With a suitable dimensioning of the flow connection provided as an annular gap in the valve and of the two boundary surfaces of the shut-off body of the second control valve facing away from one another, of which one is associated with the valve control opening and the other with the valve inlet opening, at a sufficient working fluid pressure in the flow path for conducting the volume flow of the working fluid in the second direction—preferably from a hydraulic consumer to a reservoir—thus via the valve inlet opening a movement of the shut-off body from the close- to the open-position of the second control valve and consequently a volume flow of the working fluid in the flow path in the second direction is therefore made possible. In the first position of the coupling means of the pilot control means, directed opposite to this movement of the shut-off body is primarily the retaining force of the retaining means of the second control valve, which preferably comprises a compression spring.

The flow connection to the valve control opening of the second control valve in this embodiment of the inventive control device is thus provided in a manner configurable by the coupling means of the pilot control means that it exists in the first position of the coupling means between the valve control opening and the flow path for conducting the volume flow of the working fluid in the second direction and in the second position of the coupling means between the valve control opening and the flow path for conducting the volume flow of the working fluid in the first direction via a direct and an indirect flow connection in each case.

BRIEF DESCRIPTION OF THE DRAWINGS

A preferred embodiment of the present invention is explained below in an exemplary manner with reference to the accompanying drawings. In the drawings.

DETAILED DESCRIPTION OF THE INVENTION

Figure 1:
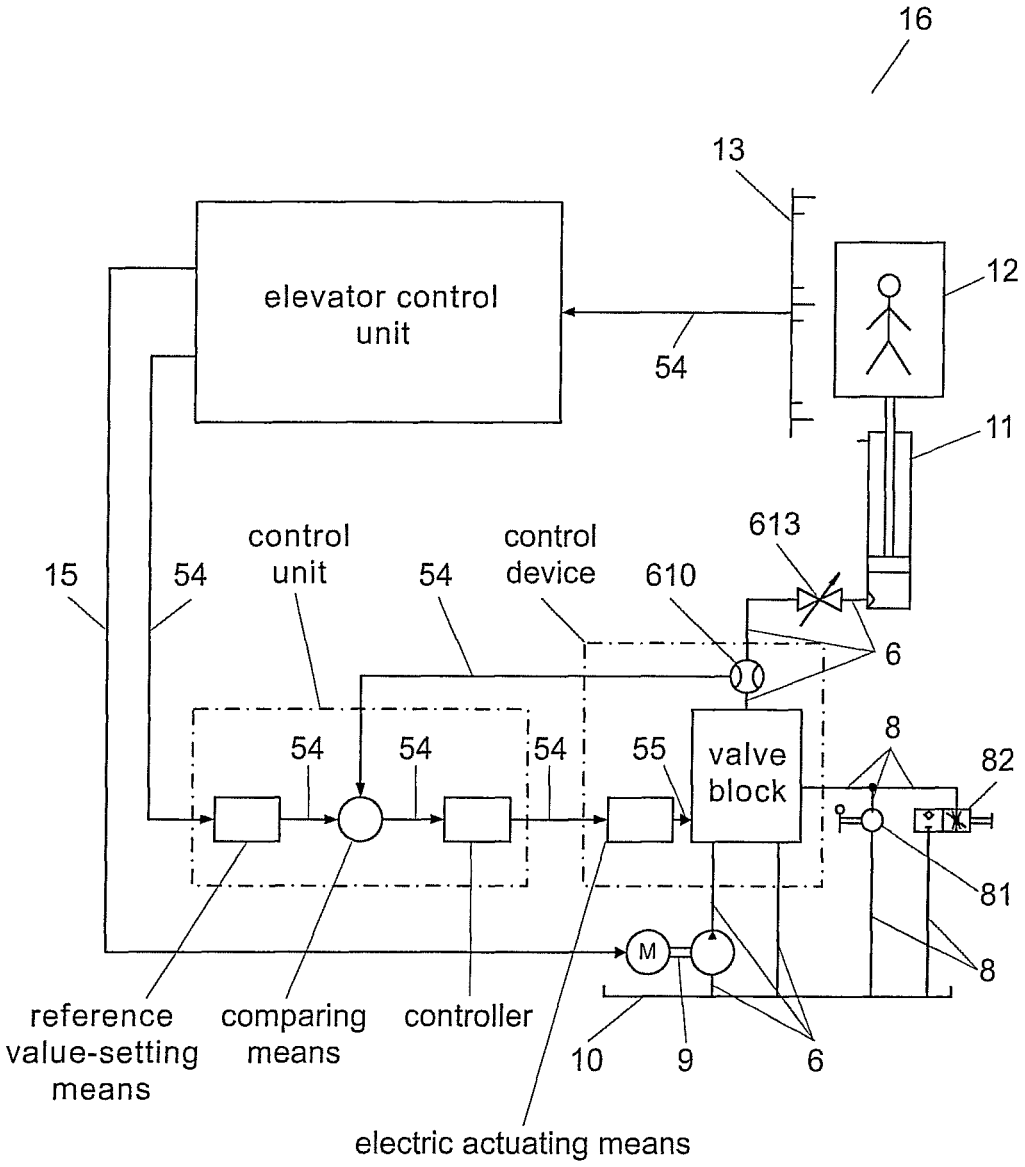
FIG. 1 is a circuit diagram of a hydraulic drive system for an elevator with the inventive control device.

The preferred embodiment of the invention illustrated in the drawings sets forth the best mode for carrying out the invention. This best mode embodiment of the present invention will be described in detail below. In FIG. 1 the electro-hydraulic circuit diagram of a hydraulic drive system 16 for an elevator is shown in which the inventive control device 1 carries out controlling and timing of the lifting and lowering motion. Hydraulic elevator systems of this kind are used in buildings with several floors, especially in buildings with up to six floors, and have a movable elevator car 12 suitable for transportation of passengers and/or goods. As further components the hydraulic drive system 16 comprises a control device 1 with a valve block 2 which is connected via a flow path 6 in the form of a hydraulic power conduit usually provided as a pipe joint with a hydraulic cylinder 11 as a hydraulic drive. The hydraulic cylinder 11 is configured as a single-stage drive cylinder and coupled with the elevator car 12 so that the volume flow of a working fluid from the valve block 2 to the hydraulic cylinder 11 causes a lifting motion of the elevator car 12 via an extension stroke of the drive cylinder. By means of a stop valve 613 in the hydraulic power conduit comprised in the flow path 6 the single-stage drive cylinder can be locked in any extended position, whereby the elevator car 12 can safely be brought to a stop in a defined position, i.e. on the ground floor, especially at a system maintenance or replacement of individual system components. Moreover, the flow path 6 features a flow measuring means 610 between the valve block 2 and the stop valve 613 for determining the volume flow of the working fluid in both directions of flow between a reservoir 10 and the hydraulic cylinder 11.

The flow path 6 in the form of the hydraulic power conduit continues from the valve block 2 of the control device 1 to a pump 9 with a motor drive, which is designed as a screw pump with an electric motor as a drive mechanism, and from that further to the reservoir 10 for supplying the working fluid. For the return flow of the working fluid, the valve block 2 is directly connected to the reservoir 10 via a further hydraulic power conduit comprised in the flow path 6. The return flow of the working fluid from the hydraulic cylinder 11 via the flow measuring means 610 and the valve block 2 and/or directly from the valve block 2 into the reservoir 10 can be controlled in this way by an electromagnetic actuating means 4 comprised in the control device 1. The working fluid used is a mineral oil-based hydraulic oil. In accordance with the applicable safety regulations for elevator equipment, the inventive control device 1 is in addition connected to a hydraulic safety conduit 8 which connects the valve block 2 on the one hand through an emergency discharge valve 82 and on the other hand through a hand pump 81 in each case with the reservoir 10.

For detecting the position of the elevator car 12 along its travel path between the floors, a position detecting means 13 is provided in the hydraulic drive system 16 in a conventional manner. This is connected by an electric signal line 54 with an elevator control unit 14 which, depending on a position-signal generated by the position detecting means 13, activates the electric motor of the pump 9 by means of an electric power line 15 on the one hand. On the other hand, the elevator control unit 14 transforms the position signal into a reference value for the elevator car speed which is transmitted by means of a further electric signal line 54 to the reference value input of a control unit 5 with PID characteristics (PID—proportional-integral-differential). The control unit 5 comprises in serial connection a reference value-setting means 51 for converting the reference value signal generated by means of the elevator control unit 14, a comparing means 52 with a reference value input, an actual value input, and a differential value output for forming a differential signal as the output variable from the reference value signal and the actual value signal, and a controller 53 for generating a control signal from the differential signal corresponding to the control characteristic. The input variable supplied to the comparing means 52 of the control unit 5 via its actual value input by means of a further electric signal line 54 is formed by the flow measuring means 610 of the control device 1 from the particular speed of the volume flow of the working fluid in the flow path 6 as an electrical actual value signal. The electrical control signal generated in the control unit 5 is finally conducted to the electro-magnetic actuating means 4 of the control device 1 via a further electric signal line 54 to adjust via a mechanical signal line 55 in the form of an operating displacement the volume flow of the working fluid to and from the hydraulic cylinder 11 as a hydraulic drive of the elevator car 12 by means of the valve block 2 comprised in the control device 1 accordingly. The actual value signal generated in the control device 1 in accordance with the flow rate of the working fluid in the flow path 6 to and from the hydraulic cylinder 11 is thus proportional to the speed of the elevator car 12 at its lifting and lowering motion, i.e. upward and downward travel.

As customary, the movement of the elevator car 12 is carried out with two different velocities, namely a higher one for the travel between the floors and a lower one for the inch-travel for exact positioning of the elevator car 12 at stopping on a floor, wherein switching between the two velocities is provided by the inventive control device 1 depending on the position signals of the position detecting means 13 during lifting and lowering respectively of the elevator car 12. When in drive mode, the elevator control unit 14 generates in a known manner in addition to a first electrical signal for the fast mode a second electrical signal for the slow mode. The former is switched off on reaching a particular landing position as defined by the position detecting means 13, while the second signal is still present, which in turn causes the deceleration of the elevator car 12. The fine positioning in reaching the floor is then carried out by using a limit switch, or rather, floor switch which is located approximately 1 cm below or above the particular limit position. In this way it is guaranteed that the elevator car 12 is decelerated to a halt when it reaches the position of the particular switches both at lifting and at lowering and comes to a stop precisely at the predetermined stop position.

In the hydraulic drive system 16 a speed signal is thus generated in a known manner in the elevator control unit 14 as a function of the position of the elevator car 12 detected by the position detecting means 13. From this speed parameter for the elevator car 12 a reference value signal for the elevator car speed, or for the flow rate of the working fluid proportional with it, is formed in the reference value-setting means 51 of the control unit 5 in turn, which is compared with the actual value of the flow rate of the working fluid detected by the flow measuring means 610. If there is a deviation between the actual value and the reference value of the elevator car speed, the control unit 5 provides a corresponding electrical control signal which activates the electromagnetic actuating means 4 and controls the volume flow of the working fluid in the flow path 6 by means of the valve block 2, consequently increases or reduces the speed of the elevator car 12 in the particular direction of travel accordingly. The hydraulic drive system 16 therefore forms a closed loop circuit.

Figure 2:
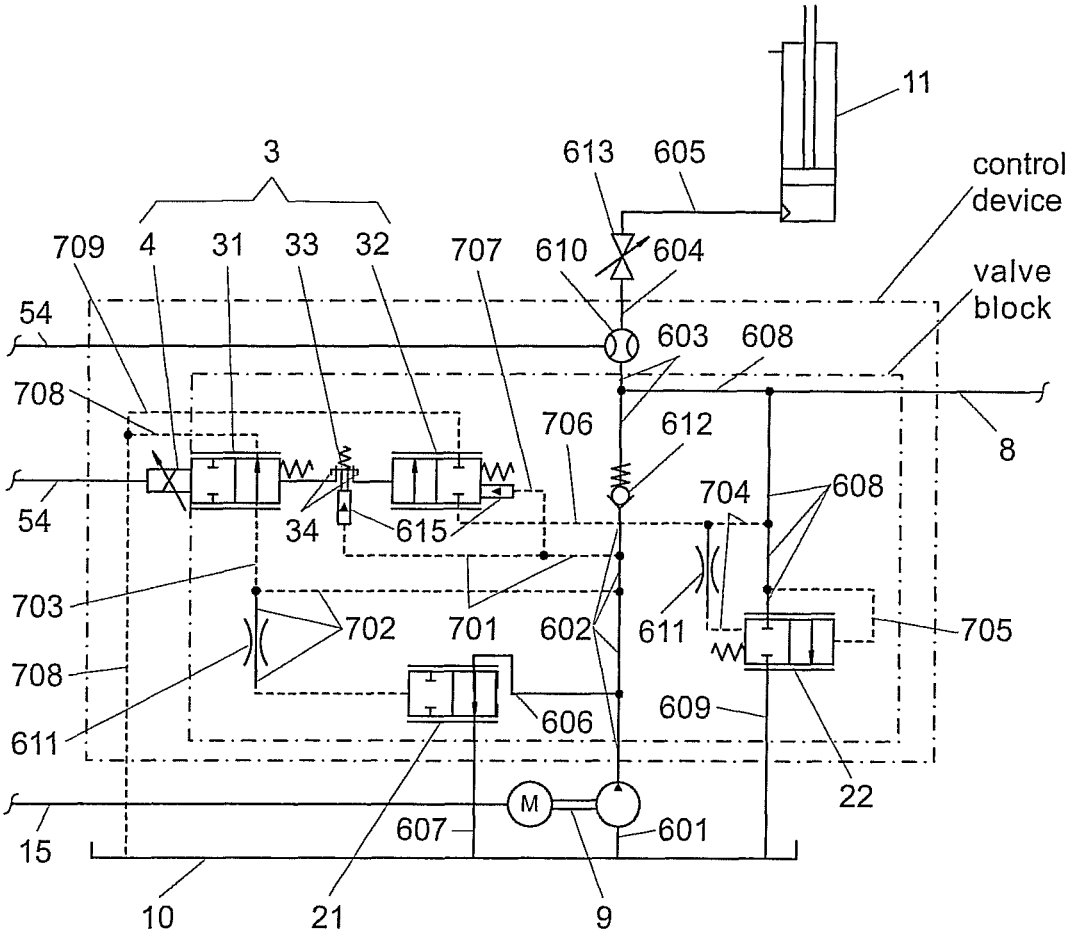
FIG. 2 is the circuit diagram of the inventive control device in detailed representation with a hydraulic drive.

In FIG. 2 the circuit diagram of the inventive control device 1 is indicated in a detailed view with a hydraulic cylinder 11, and a motor-driven pump 9, and a reservoir 10 for the working fluid. The reservoir 10 serves in addition to supplying the necessary working fluid for the operation of the control device 1 and of the hydraulic drive, or rather, hydraulic cylinder 11 also for receiving the working fluid flowing back from the control device 1 and/or such consumer. In this case as the working fluid, a hydraulic oil on the basis of mineral oil is provided. The valve block 2 comprised in the control device 1 features a hydraulic power section with a spring-loaded check valve 612 which allows the working fluid flow in the first direction from the reservoir 10 through the flow measuring means 610 to the hydraulic cylinder 11 in the flow path 6 according to FIG. 1 and prevents this in the opposite direction. The check valve 612 defines by the spring constant of its return spring the threshold of the working fluid pressure, which has to be overcome by the volume flow of the working fluid to pass through the flow path from the reservoir 10 to the hydraulic cylinder 11. Further, the valve block 2 has an electro-hydraulic control section which primarily comprises a pilot control means 3.

The valve block 2 is connected in the manner shown in FIG. 1 by means of the flow path 6 in the form of a plurality of hydraulic power conduits to the reservoir 10 and through the flow measuring means 610 to the hydraulic cylinder 11. The flow path 6 comprises according to FIG. 2 in detail a first hydraulic power conduit 610 which extends from the reservoir 10 to the inlet of the motor-driven pump 9, a second hydraulic power conduit 602 which connects the outlet of the motor-driven pump 9 with the inlet opening of the check valve 612, a third hydraulic power conduit 603 which extends from the outlet opening of the check valve 612 to the hydraulic input, i.e. inlet, of the flow measuring means 610, a fourth hydraulic power conduit 604 which connects the hydraulic output of the flow measuring means 610 with the inlet of a stop valve 613, and a fifth hydraulic power conduit 605 which ultimately establishes the flow connection of the outlet of the stop valve 613 to a working fluid port of the hydraulic cylinder 11.

The functional integration of the inventive control device 1 into a hydraulic drive system 16 according to FIG. 1 is carried out via the conduit means 6, 8, 15, 54, and 55 in the way shown in FIG. 1, of which the conduit means 6 and 8 are associated with the hydraulic power section and the conduit means 15, 54, and 55 with the electro-hydraulic control section of the valve block 2; the mechanical signal line 55 is in this case designed as the actuating path of an electric actuating means 4. The hydraulic power section of the inventive control device 1 further comprises a sixth hydraulic power conduit 606 with the first end of the latter connected to the second hydraulic power conduit 602 and the second end to the inlet opening of a first control valve 21; in the embodiment of the first control valve 21 according to FIG. 4, this connection exists with the valve inlet opening 220. The first control valve 21 is designed as a continuously adjustable 2/2-way valve (valve having an open- and close-position, or rather, two switching positions and two hydraulic ports) with a mechanical retaining means 209 according to FIG. 4 in the form of a cylindrical compression spring of spring steel, as usual, configured to close the valve in its rest position and controls the working fluid supply to the hydraulic drive, or rather, hydraulic cylinder 11 through the return flow of the working fluid from the second hydraulic power conduit 602 via a seventh hydraulic power conduit 607 provided between the outlet—the valve outlet opening 221 according to FIG. 4—of the first control valve 21 and the reservoir 10. By this arrangement of the first control valve 21 and a suitable dimensioning of the retaining force, or rather, spring force of the retaining means 209 comprised therein according to FIG. 4 which closes the valve in its rest position, it is ensured that the first control valve 21 opens when the motor-driven pump 9 is in operation and at the same time the first pilot valve 31 of the pilot control means 3 is open, i.e. is in its rest position; the actuation of the first pilot valve 31 is effected by activation of the electric actuating means 4 as indicated in detail in connection with FIG. 1. The first pilot valve 31 thus effects in its open-position a pressure drop in the flow path 6 of a hydraulic drive system 16 according to FIG. 1 and thereby prevents a volume flow in the first direction, i.e. to the hydraulic cylinder 11, namely as long as the retaining force of the check valve 612 arranged in the flow path 6 is overcome by the working fluid pressure.

Figure 6:
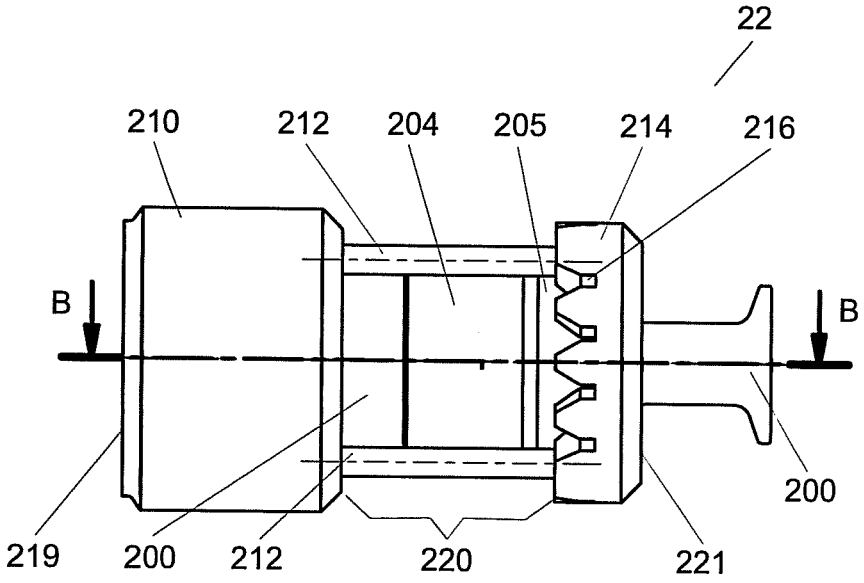
FIG. 6 is a side view of an inventive embodiment of the second control valve as an element of a control device in accordance with FIG. 2.

For the return flow of the working fluid from the hydraulic cylinder 11 to the reservoir 10, the hydraulic power section of the inventive control device 1 features an eighth and ninth hydraulic power conduit 608, 609, wherein the former is connected with its first end to the third hydraulic power conduit 603 and with its second end to the inlet of a second control valve 22, which is configured as a 2/2-way pressure differential valve—in the embodiment of the second control valve 22 according to FIG. 6, the connection is to the valve inlet opening 220 —, while the latter is arranged between the outlet—the valve outlet opening 221 according to FIG. 6—of the second control valve 22 and the reservoir 10. Through this conduit it is ensured that the flow measuring means 610 that is provided in a known manner for bidirectional flow measurement detects both the flow rate of the working fluid to and from the hydraulic cylinder 11. The hydraulic safety conduit 8 by which an emergency discharge valve 82 and a hand pump 81 as legally required safety components are connected according to FIG. 1 in a parallel arrangement with the valve block 2, branches off the eighth hydraulic power conduit 608.

The pilot control means 3 associated with the electro-hydraulic control section of the inventive control device 1 comprises in detail in addition to the first pilot valve 31 a second pilot valve 32, a coupling means 33 having a coupling region 34, and the electric actuating means 4. The two pilot valves 31, 32 are configured as continuously adjustable 2/2-way valves, wherein the first pilot valve 31 and the electric actuating means 4 together form an electromagnetic valve, and wherein each of the two pilot valves 31, 32 features a mechanical actuating means in the form of a cylindrical coil spring, or compression spring, in each case which keeps the particular pilot valve closed in its rest position; each actuating means in each case acts on the shut-off body, i.e. piston, of the particular pilot valve via the valve control opening. In order to keep the second pilot valve 32 also in the case of an increased hydraulic pressure on its valve control opening securely in its close-position, in particular in the decoupled state, as it occurs during flow of working fluid from the motor-driven pump 9 to the hydraulic cylinder 11, and thereby during upward travel of the elevator car 12 in a hydraulic drive system 16 according to FIG. 1, the actuating means of the second pilot valve 32 comprises in addition to the compression spring a conventional hydro-mechanical transmission means 615 which is connected to the second hydraulic power conduit 602 and which acts parallel to the compression spring via the valve control opening on the shut-off body of the valve. This transmission means in the form of a hydraulically decoupled plunger allows a dynamic adaption of the closing pressure to particular pressure conditions in the flow path 6 of the working fluid from the reservoir 10 to the hydraulic cylinder 11 and is dimensioned in a way that the function of the second pilot valve 32 and in this respect of the pilot control means 3 in each case reliably is ensured.

The coupling means 33 concerned is a metallic connecting piece movable to and fro between a first and a second position which comprises on its side facing the two pilot valves 31, 32 to be coupled a coupling region 34 with projections for the releasable mechanical connection of the pistons of the two pilot valves 31, 32 in its first position. The pistons, or shut-off bodies, of the first and second pilot valve 31, 32 are for this purpose formed in pistil-shape at its opposite ends in a corresponding manner so that the two pilot valves 31, 32 in the first position of the coupling region 34 of the coupling means 33 shown in FIG. 2 are detachably interconnected and synchronously operable by the electric actuating means 4. Alternatively and equally preferred, the coupling means may be provided in the form of a steel ball with its surface constituting the coupling region 34 as indicated in detail in connection with FIG. 3.

As can be further learned from FIG. 2, the coupling of the two pilot valves 31, 32 in the first position of the coupling means 33 formed as mechanical connecting means in this case takes place under the action of a defined retaining force on the two valve pistons. The retaining force mainly results from the spring force of a cylindrical compression spring and is dimensioned in such a way that the coupling means 33 with its coupling region 34 reliably allows in its first position the synchronous actuation for the two pilot valves 31, 32 by the electric actuating means 4. The synchronous movement of the two valve pistons in the case of coupling also is ensured in particular by the retaining force of the actuating means associated with the second pilot valve 32 which in this embodiment additionally comprises a hydro-mechanical transmission means 615 along with a compression spring; by the inventive structural assignment of the two valve pistons and the particular actuating means to one another, the retaining force of the actuating means of the second pilot valve 32 acts in the direction of movement of the electric actuating means 4 of the first pilot valve 31 and contrary to its actuating force for actuating the valve piston, or shut-off body, from its open- to its close-position so that the valve pistons of the two pilot valves 31, 32 are mechanically biased against each other. In this case, the required restoring force is provided by the particular actuating means of the first and second pilot valve 31, 32. The electric actuating means 4 comprises an electromagnet for generating an actuating force which is chosen such that a reliable synchronous actuation of the two coupled pilot valves 31, 32 is at all events possible if the motor-driven pump 9 is turned off.

If the coupling means 33 with its coupling region 34 assumes its second position, the two pilot valves 31, 32 are decoupled so that each pilot valve 31, 32 can be actuated only by it own actuating means. In other words, in the illustrated embodiment of the inventive control device 1, the second pilot valve 32 is moved to its close-position by the force of its actuating means and held in this position, while the first pilot valve 31 individually and against the retaining force of the compression spring provided as resetting means can be actuated trough the electric actuating means 4 once the two pilot valves 31, 32 are decoupled, consequently the mechanical connecting means provided as coupling means 33 is moved to its second position due to an increase of the working fluid pressure in the second hydraulic power conduit 602 above a defined threshold.

Specifically, the displacement of the coupling means 33 from its first to its second position is carried out indirectly via a plunger by means of the working fluid against the spring force of the cylindrical compression spring, or rather, the retaining force of the coupling means 33 as a function of the working fluid pressure prevailing in the second hydraulic power conduit 602; the working fluid thus constitutes the impulse generating means in this case. The coupling means 33 and the second hydraulic power conduit 602 are connected by a first hydraulic control conduit 701, wherein the hydro-mechanical transmission means 615 associated with the second pilot valve 32 co-operates with the first hydraulic control conduit 701 via a seventh hydraulic control conduit 707. The coupling of the two pilot valves 31, 32 is therefore effected whenever the actuating force generated by the working fluid pressure in the first hydraulic control conduit 701 through the coupling means 33 falls below a threshold defined by the retaining force, as is regularly the case during standstill or downward travel of the elevator car 12 in a hydraulic drive system 16 according to FIG. 1 when the motor drive of the pump 9 is switched off.

Figure 4:
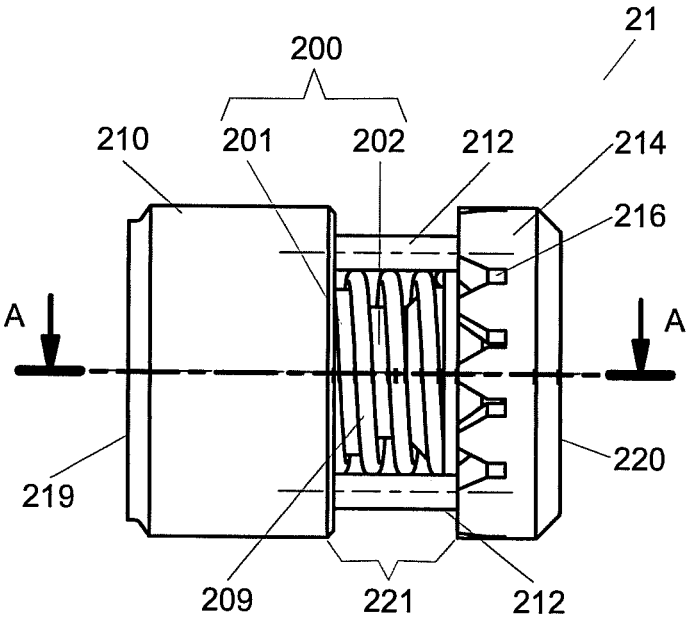
FIG. 4 is a side view of an inventive embodiment of the first control valve as element of a control device in accordance with FIG. 2.

The valve inlet opening of the first pilot valve 31 is connected via a third and second hydraulic control conduit 703, 702 to the second hydraulic power conduit 602 which by itself is carried on to the control opening—the valve control opening 219 according to FIG. 4—of the first control valve 21. The second hydraulic control conduit 702 has between the junction of the third hydraulic control conduit 703 and the control opening of the first control valve 21 a throttle element 611 to dampen variations of the working fluid pressure induced by alternation of load and is connected directly to the control opening of the first control valve 21 so that the actuation of the latter is effected by the working fluid subject to the working fluid pressure in the second hydraulic power conduit 602 which is controllable by means of the first pilot valve 31. The first control valve 21 is closed in its rest position by means of the cylindrical compression spring—retaining means 209 according to FIG. 4 —, wherein the spring force is dimensioned in such a way that the working fluid pressure generated by the motor-driven pump 9 in absence of pay load and/or with the hydraulic cylinder 11 in idle mode suffices to open the first control valve 21 and to conduct the volume flow of the working fluid conveyed by the pump 9 between the reservoir 10 via the first, second, sixth, and seventh hydraulic power conduit 601, 602, 606, 607 through the first control valve 21 in bypass without effecting a volume flow of the working fluid to the hydraulic cylinder 11.

The inlet of the second pilot valve 32 is connected via a sixth hydraulic control conduit 706 to a fourth hydraulic control conduit 704, which is coupled with its first end to the eighth hydraulic power conduit 608 and with its second end to the control opening—the valve control opening 219 according to FIG. 6—of the second control valve 22; for limiting the effect of pressure variations of the working fluid induced by alternating loads in the fourth hydraulic control conduit 704 onto the control opening and to ensure in particular a defined switching behavior when opening the second control valve 22, a throttle element 611 is provided between the connection of the sixth hydraulic control conduit 706 and the control opening. The piston—shut-off body 200 according to FIG. 6—of the second control valve 22 is biased for the purpose of a reliable closure in its rest position by a cylindrical compression spring—retaining means 209 according to FIG. 7 —, whereby a threshold for actuating the valve is defined which will be overcome at a corresponding pressure difference of the working fluid in the eighth hydraulic power conduit 608 and the fourth hydraulic control conduit 704; if the working fluid pressure at the control opening of the second control valve 22 thus falls below this threshold, the working fluid in the flow path 6 in a hydraulic drive system 16 according to FIG. 1 can flow in the second direction from the hydraulic cylinder 11 to the reservoir 10 through the power conduit segments 605, 604, 603, 608, and 609 shown in FIG. 2 in detail.

Figure 7:
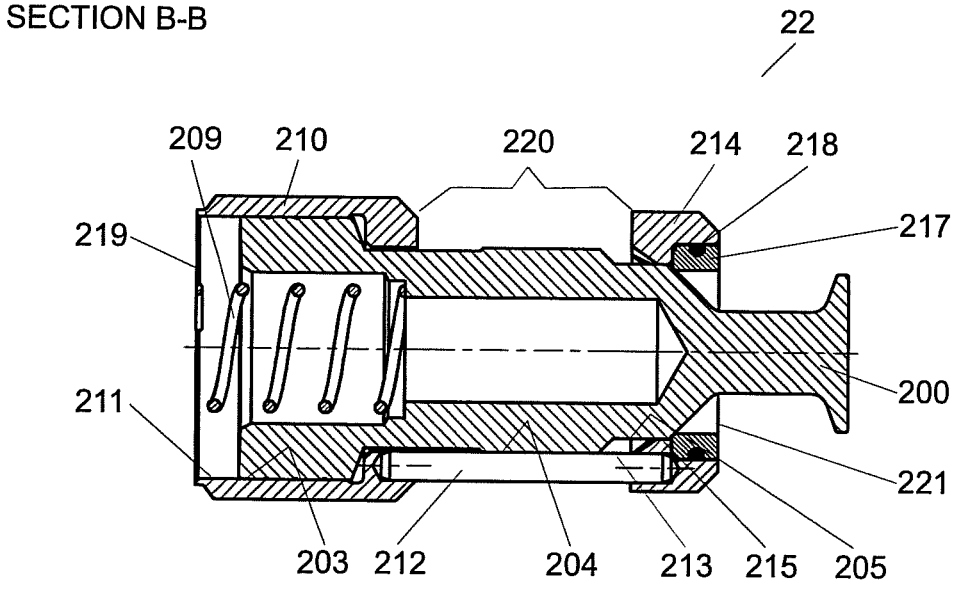
FIG. 7 is a sectional view of the second control valve in accordance with FIG. 6.
Figure 8:
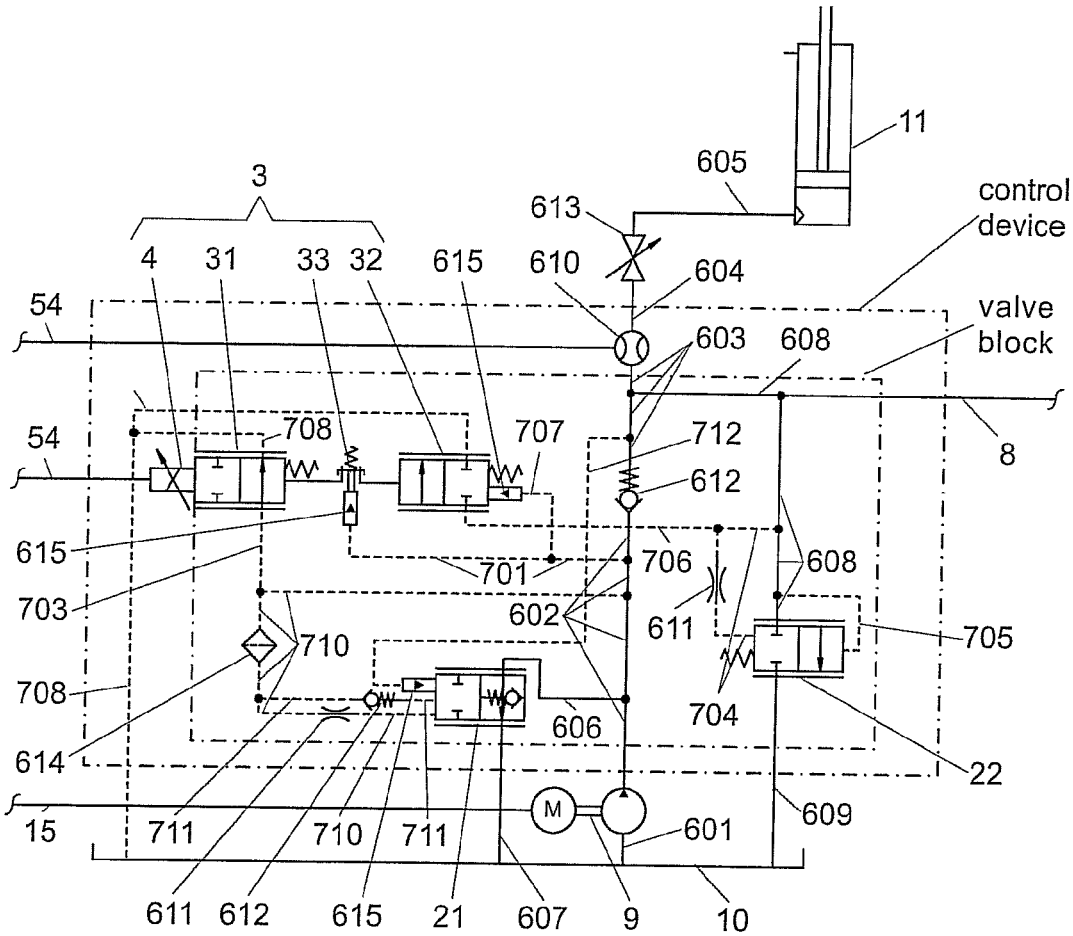
FIG. 8 is the circuit diagram of another embodiment of the inventive control device in detailed representation with a hydraulic drive.

Moreover, the second control valve 22 comprises according to FIG. 7 between its valve inlet opening 220 and its first guide means part 210 a flow connection in the form of an annular gap via which the working fluid pressure prevailing at the valve inlet opening 220 at any one time can act on the shut-off body 200—more precisely, on the conical transition area formed between the first and second shut-off body region 203, 204—so that the resulting actuating force is opposed to the actuating force acting on the shut-off body 200 via the valve control opening 219 and causes an actuation of the shut-off body 200 from its close- to its open-position; the flow connection in the form of the annular gap is shown in FIGS. 2 and 8 as the fifth hydraulic control conduit 705 between the eighth hydraulic power conduit 608 and the second control valve 22. Finally, there are provided for the return of the working fluid from the pilot control means 3 to the reservoir 10 an eighth hydraulic control conduit 708 between the outlet of the first pilot valve 31 and the reservoir 10 and a ninth hydraulic control conduit 709, wherein the latter connects the outlet of the second pilot valve 32 with the eighth hydraulic control conduit 708.

Figure 3:
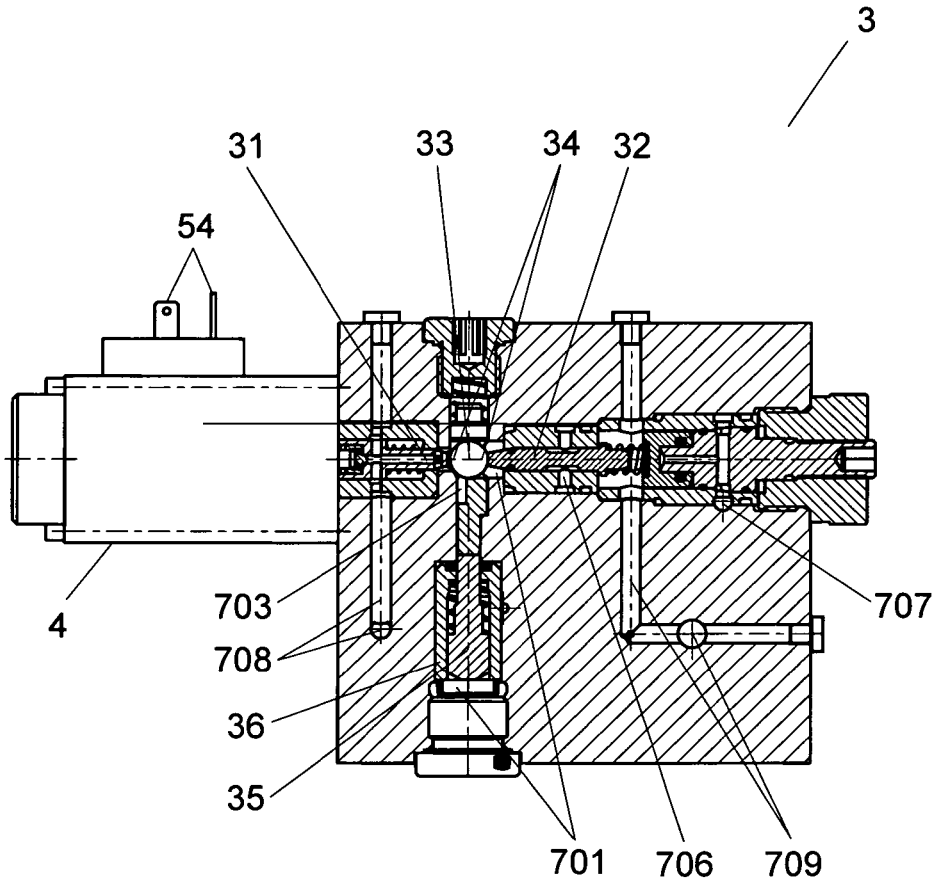
FIG. 3 is a side view of a pilot control means in structural design as a detail of a control device in accordance with FIG. 2 in partial section.

FIG. 3 shows the pilot control means 3 as schematically illustrated in FIG. 2 in a structural alternative embodiment. The pilot control means 3 constitutes with the associated flow connections, the flow measuring means 610, and the electric signal lines 54 the electro-hydraulic control section of the valve block 2 of the inventive control device 1 according to FIG. 2. The illustrated pilot control means 3 comprises in a housing formed as a metal cuboid with borings the first and second pilot valve 31, 32, and the coupling means 33 with the coupling region 34, and the impulse transmission means 35 in the form of a plunger which is slidably mounted against a compression spring in an impulse guiding means 36 formed as a cupular guide bushing, and an electric actuating means 4 having an electromagnet as actuator. Because of this structural design, the pilot control means 3 is usually also referred to as pilot-control block. Further borings in the metal cuboid form segments of the flow connections, namely of the first, third, sixth, seventh, eighth, and ninth hydraulic control conduits 701, 703, 706, 707, 708, 709 which according to FIG. 2 serve for the activation of the individual actuators of the control device 1; the borings are carried out from the boundary surfaces of the metal block and conventionally sealed in a leak-proof manner with a casing expander there where the continuation of a flow connection at the particular boundary surface of the metal block is not provided.

In the alternative embodiment of the electro-hydraulic control section of the inventive control device 1 according to FIG. 3, the electric actuating means 4 and the two pilot valves 31, 32 are disposed on a common first actuating line, as already mentioned in connection with FIG. 2. Thereto, the electric actuating means 4 is flanged on the boundary surface of the metal cuboid comprising the first pilot valve 31 correspondingly. A second actuating line, where the coupling means 33 with its coupling region 34 reciprocates between its first and second position under the action of the impulse transmission means 35, which analogously is moved by the working fluid as impulse generating means, perpendicularly intersects the first actuating line between the first and second pilot valve 31, 32, more precisely between the opposing valve pistons of the same.

As coupling means 33 is a commercially available steel ball provided with its surface comprising the coupling region 34 by which the two pilot valves 31, 32, more precisely its valve pistons, co-operate in the first position of the coupling region 34 of the coupling means 33 and can be moved synchronously by the electric actuating means 4. The retaining force that holds the coupling means 33 with its coupling region 34 in its first position in the starting position, or the restoring force which returns it to the latter, is provided primarily by the spring force of a cylindrical compression spring; in the embodiment of the pilot control means 3 according to FIG. 3, a metallic connector between spring and steel ball ensures a defined power transmission. In an alternative embodiment of the pilot control means 3, the retaining force and the restoring force of the coupling means 33 formed as a steel ball solely is ensured by its own weight, hence through a suitable dimensioning of the ball mass. Thus, the additional use of a compression spring and of a connecting piece is unnecessary. The components contacting each other during coupling of the two pilot valves 31, 32 are shaped in the particular contact area in a customary manner in such a way that the coupling is possible under avoidance of friction as far as possible. This is achieved in the two alternative embodiments in particular by the use of a steel ball with a high-surface quality, namely low surface roughness, high dimensional stability, and high mechanical resistance. In the two alternative embodiments, the steel ball as the coupling means 33 is and said coupling means, the connecting piece, and the spring are in addition guided in a corresponding bore in the pilot-control block in each case, which is sealed fluid-tight by means of an adjusting screw and dimensioned so that the movement of the coupling region 34 of the coupling means 33 to its second position inside of the bore is ensured.

FIG. 4 shows a particularly advantageous embodiment of the first control valve 21 in a side view with the valve inlet opening 220 closed. In the inventive control device 1 corresponding to FIG. 2, the first control valve 21 in this embodiment controls the volume flow of the working fluid in the flow path 6 from the reservoir 10 to the hydraulic drive, or rather, hydraulic cylinder 11 in the bypass-mode and can in this respect also be referred to as upward-valve. The first control valve 21 in this embodiment is configured as 2/2-way valve with a continuously adjustable differential piston. The shut-off body 200 comprises two essentially circular cylindrical shut-off body parts 201, 202, each of which is disposed with its particular cylinder axis in congruent arrangement with the longitudinal axis of the valve and in each case slidably mounted on the one hand relative to a first, second, and third guide means part 210, 212, 214 and on the other hand relative to the particular neighboring shut-off body part in each case along the longitudinal axis of the valve. The individual valve components and their functional interaction are explained below in particular with reference to FIG. 5 which represents the first control valve 21 according to FIG. 4 in a sectional view taken along the intersection line A-A indicated there.

The two circular-cylindrical shut-off body parts 201, 202 are formed in each case substantially in their region corresponding to the valve outlet opening 221 as a hollow cylinder, wherein the outer and inner diameters are selected in such a way that in addition to a sufficient mechanical stability in each case the hollow cylinder comprised in the first shut-off body part 201 with a fourth shut-off body part region 206 partially surrounds the hollow cylinder comprised in the second shut-off body part 202 with a fifth shut-off body part region 207. In the hollow cylinder comprised in the second shut-off body part 202 at least one pressure equalization bore 208 is provided which connects the internal space of the shut-off body 200 formed in this way to the outlet region of the first control valve 21, i.e. with the valve outlet opening 221, hence ensuring the relative relocatability of the two shut-off body parts 201, 202 to each other in the valve operation; since the length of the fourth shut-off body region 206 compared to the length of the fifth shut-off body region 207 is shortened and each pressure equalization bore 208 is arranged outside of the possible overlapping area in the fifth shut-off body region 207, the pressure equalization between the internal space and the valve outlet opening 221 of the first control valve 21 is always guaranteed. In the embodiment of the first control valve 21 of the inventive control device 1 according to FIGS. 4 and 5, the valve block 2 is provided with an appropriate abutment, or stop, as limitation for the operating displacement of the first shut-off body part 201 of the shut-off body 200. In an alternative embodiment of the first control valve 21, a suitable stop for the first shut-off body part 201 is provided directly on the first guide means part 210 formed as a bushing.

By means of a cylindrical compression spring as the retaining means 209 which in each case encloses at least partially the two hollow cylinders without coming into contact with the guide means parts 210, 212, 214 and which couples the two shut-off body parts 201, 202 in such a way that the fourth shut-off body region 206 of the hollow cylinder of the first shut-off body part 201 overlaps over about half its length with the fifth shut-off body region 207 of the hollow cylinder of the second shut-off body part 202 in the close-position of the valve and without charging the valve control opening 219 with pressure, the relative relocatability of the two shut-off body parts 201, 202 is on the one hand ensured with respect to the guide means parts 210, 212, 214 and on the other hand with respect to each other. In this rest-position of the retaining means 209 of the first control valve 21 it is incidentally ensured by a suitable longitudinal extension of the first guide means part 210 and/or of the retaining means 209 in the axial direction in each case that the shut-off body 200 does not project with its first shut-off body part 201 from the valve control opening 219.

With this configuration of the first control valve 21 and a dimensioning of the retaining means 209 used therein in consideration of the working fluid pressure minimum prevailing at its valve inlet opening 220, a self-actuating, i.e. automatic, adjustment of the operating point of the valve is enabled, consisting in detail of the shut-off body 200 being capable of reacting on the one hand to pressure fluctuations at the valve control opening 219 or at the valve inlet opening 220 by a movement of the first or second shut-off body part 201, 202 and on the other hand to a change in the pressure level at the valve control opening 219 and/or at the valve inlet opening 220 by changing of its length or position relative to the valve inlet opening 220 and/or the valve control opening 219, and with it to the valve outlet opening 221, in a differentiated way in each case. This self-actuating adjustment of the operating point of the first control valve 21 thus allows in the preferred embodiment of the inventive control device 1 according to FIG. 2 in a hydraulic system according to FIG. 1 an automatic compensation of load-induced variations of the working fluid pressure as they may occur in the flow path 6 from the motor-driven pump 9 to a hydraulic drive, or rather, hydraulic cylinder 11 and in detail may act via the sixth hydraulic power conduit 606 and the valve inlet opening 220 and/or via the third hydraulic control conduit 703 and the valve control opening 219 on the shut-off body 200 of the valve. Compared with known control devices, this results in the essential advantage that an optimal approach behavior of the elevator car 12 in a hydraulic drive system 16 according to FIG. 1 is for each elevator load up to the permissible maximum load in each case, or rather, from the minimum up to the maximum load pressure equally guaranteed; conventional drive systems of the aforementioned type are usually set to an operation with an average load pressure so that any deviation of the actual load pressure from the preset nominal average load pressure entails an impairment of the starting quality of the elevator, namely a jerky starting at load pressures below and a starting delay at load pressures above the nominal average load pressure.

For this self-actuating adjustment of the operating point, the retaining force of the retaining means 209, or rather, of the compression spring of the first control valve 21 is preferably selected in such a way that even the working fluid pressure generated upon starting of the motor-driven pump 9 in the flow path 6 according to FIG. 1—specifically, in its second hydraulic power conduit 602 according to FIG. 2—is not only sufficient to move the coupling means 33 from its first to its second position as mentioned above, but also to open the first control valve 21, i.e. the second shut-off body part 202, without simultaneously moving the first shut-off body part 201 and thus to allow for backflow of the working fluid to the reservoir 10 in the bypass-mode; this dimensioning of the retaining forces of the coupling means 33 and of the retaining means 209, therefore defines the minimum circulation pressure, or pilot pressure, of the working fluid in the hydraulic system. A full penetration of the hollow cylinder of the second shut-off body part 202 in the hollow cylinder, or rather, boring of the first shut-off body part 201—and consequently a rigid coupling of the two shut-off body parts 201, 202—is only possible on a load pressure of the working fluid at the valve inlet opening 220 and/or at the valve control opening 219, i.e. in the sixth hydraulic power conduit 606 and/or in the second hydraulic control conduit 702 of the control device 1, which is suitable to overcome the retaining force provided by the compression spring as the retaining means 209 with corresponding shortening of the length of the spring.

Figure 5:
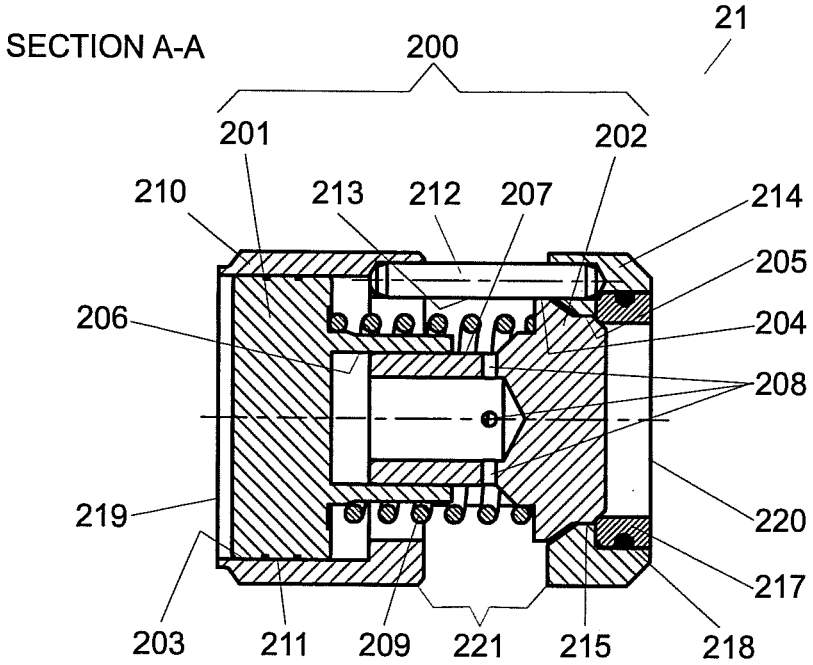
FIG. 5 is a sectional view of the first control valve in accordance with FIG. 4.

The valve body of the first control valve 21 comprises in the embodiment shown in FIGS. 4 and 5 of a first guide bushing 210 with the free end of which defining the valve control opening 219, of a second guide bushing 214 with the free end of which defining the valve inlet opening 220, and of three equidistant guide pins 212 extending in between with the free spaces defining the valve outlet opening 221. Each of the guide pins 212 is permanently fixed to the first and second guide bushing 210, 214. The two guide bushings 210, 214 of this embodiment of the first control valve 21 are turned parts made of steel with mounting holes for the guide pins 212; alternatively, the guide bushings 210, 214 of a valve configured in such a way may equally be molded of die-cast metal or any other material commonly used for hydraulic valves. The guide pins 212 are made of conventional semi-finished steel bar stock merely by appropriate cutting, wherein the semi-finished parts have in addition to a suitable diameter already the required surface quality too. The mounting holes are dimensioned so that a reliable press-fit connection between each guide bushing 210, 214 and each guide pin 212 is assured. Although in this valve design the permanent joint between guide bushings and guide pins is produced by pressing, nonetheless it may be useful in certain cases to apply other common types of connection, such as gluing and/or screwing for establishing the permanent joint between the three guide means parts 210, 212, 214.

The third guide means part 214 formed as guide bushing has in its region adjacent to the second guide means part 212, or rather, in its front face facing the first guide means part 210, which is also provided in the form of a guide bushing, and in the third guide means region 215 adjacent to it between the mounting holes for the guide pins of the second guide means part 212 Y-shaped recesses 216 in each case approximately to the depth of the mounting holes. The Y-shaped recesses implemented here as milled-out portions 216 in each case are composed of a triangular and a slot-shaped recess and are oriented toward the inlet of the valve 220 with the latter. The recesses provide a largely constant change of the volume flow at changeover between the close-position and the open-position of the first control valve 21 in the control device 1. To reinforce this beneficial effect, the edge of the third guide means part 214 facing the second guide means part 212 and the shut-off body 200 is provided with a bevel. The guide bushings comprised in the first and third guide means part 210, 214 are provided at their ends facing away from one another, which surround the valve control opening 219 and the valve inlet opening 220 respectively, beveled in the edge region in order to facilitate mounting in the particular valve seat which is formed as a bore in the valve block 2; the valve block 2 is provided in the form of a metallic cuboid with recesses and bores for the particular flow connections.

The first and second shut-off body part 201, 202 of the shut-off body 200 of the first control valve 21 are made of steel as turned parts and formed as substantially flat solid cylinders at their ends facing away from one another, the lateral surfaces of which in the region of their largest outer diameter in each case constitute the first and second shut-off body region 203, 204 respectively and co-operate in a sliding manner with the first and second guide means region 211, 213 respectively of the guide means, wherein the surface quality as is required for it is created by roller-burnishing in each case. In the same manner, the lateral surfaces of the hollow cylinders provided for mutual sliding co-operation of the two shut-off body parts 201, 202 comprising the fourth and fifth shut-off body region 206, 207 respectively are processed. The first shut-off body part 201 co-operates in this way via a first shut-off body region 203 with a corresponding first guide means region 211 of the first guide means part 210 configured in the form of a guide bushing, whereas the second guide means part 202 via a second shut-off body region 204 co-operates with a corresponding second guide means region 213 of the second guide means part 212 in the form of the contact lines of the three guide pins. The front end of the second shut-off body part 202 is formed by a third shut-off body region 205, the diameter of which lies between the port diameter of the valve and the maximum diameter of the second shut-off body part 202 and is beveled at its frontal boundary edge for sealing abutment on the third guide means region 215 in the close-position of the valve. This third shut-off body region 205 corresponds in this respect to the third guide means region 215 without co-operating in a sliding manner with the latter.

The third guide means region 215 is comprised in the third guide means part 214, which is configured in the form of a guide bushing too. This guide bushing has at its front end a recess in which a self-positioning annular seal insert 217 is flush mounted by means of an O-ring; the seal insert 217 is made of steel as turned part, the O-ring 218 is made in a conventional manner of a suitable elastomer, for example of a synthetic rubber such as NBR (nitrile-butadiene-rubber). For that, the O-ring 218 is accommodated in a groove within the peripheral surface of the seal insert 217, which has a slightly enlarged cross-section as against the cross-section of the O-ring. The recess for receiving the seal insert 217 is in addition formed with a slightly enlarged inner diameter with respect to the outer diameter of the latter and serves as an abutment for the O-ring 218 to which it is applied under tension. The front end of the third guide means region 215 such shaped can thus sealingly co-operate in the form of the seal insert 217 in a self-positioning manner with the third shut-off body region 205 of the shut-off body 200 in the close-position of the first control valve 21, wherein the annular edge of the seal insert 217 nearest to the shut-off body 200, which is produced by embossing, forms the contact line and its inner diameter defines the port diameter of the first control valve 21. With this type of mounting, the seal insert 217 can particularly simply be replaced, e.g. in case of damage, which not only has an advantageous effect on maintenance costs, but on valve lifetime too.

In FIG. 6 a side view of a particularly advantageous embodiment of the second control valve 22 with a closed valve outlet opening 221 is depicted. This is shown in FIG. 7 in section along the intersecting line B-B according to FIG. 6. In this constructive version, the second control valve 22 corresponds in its essential components to the preferred first control valve 21 according to FIGS. 4 and 5 with the difference that the shut-off body 200 is not realized as a two-piece differential piston, but in one piece. With the second control valve 22 depicted in FIGS. 6 and 7 in the inventive control device 1 according to FIG. 1 the volume flow of the working fluid in the flow path 6 in the form of the hydraulic power conduit from the hydraulic drive, or rather, hydraulic cylinder 11 back into the reservoir 10 is controlled, so the second control valve 22 also may be referred to as downward-valve. While with respect to the first, second, and third guide means part 210, 212, 214 with the associated first, second, and third guide means region 211, 213, 215 in each case and with respect to the properties of the first, second, and third shut-off body region 203, 204, 205 of the shut-off body 200 it therefore entirely should be referred to the description of FIGS. 4 and 5 above, the shut-off body 200 realized in one piece and the resulting valve function will be explained in detail below.

The shut-off body 200 of the second control valve 22 according to FIGS. 6 and 7 is made in one piece in the shape of a circular cylinder with different diameters along the longitudinal axis of the cylinder as turned part made of steel. For slidably co-operating with the corresponding first and second guide means region 211, 213 of the first and second guide means part 210, 212 in each case and to co-operate with the corresponding third guide means region 215 of the third guide means part 214 in the close-position of the valve, the longitudinal axis of the cylinder is arranged congruent with the longitudinal axis of the valve. The shut-off body 200 has at its end with the first shut-off body region 203 associated with the valve control opening 219 its largest outer diameter. With the third shut-off body region 205, the shut-off body 200 is associated with the valve outlet opening 221 so that the second shut-off body region 204 is located between the first and third shut-off body region 203, 205. The outer diameter of the shut-off body 200 is reduced compared to that in the first shut-off body region 203, while in the third shut-off body region 205 it is reduced over that in the second shut-off body region 204. In the third shut-off body region 205, the diameter of the shut-off body 200 in addition is greater than the port diameter of the valve proportionate to the first control valve 21. Correspondingly, the inner diameter of the first guide means part 210 is greater than that of the second guide means part 212 of which the inner diameter in turn is greater than that of the third guide means part 214; the inner diameter of the second guide means part 212 is determined by the lines of contact of the three guide pins with the shut-off body 200 which are provided in a circle around the longitudinal axis of the valve in radial arrangement.

In the transition region between the first and second shut-off body region 203, 204 and between the second and third shut-off body region 204, 205, the shut-off body 200 is provided with a bevel in each case, wherein these bevels are arranged such along the longitudinal axis of the valve body that there is no contact between the particular bevel region and the first and third guide means part 210, 214 respectively in the close-position of the valve. For a further reduction of the friction between the shut-off body 200 and the first and second guide means part 210, 212, the shut-off body regions 203, 204 which co-operate in a sliding manner with the corresponding guide means regions 211, 213 at a movement of the shut-off body 200 are additionally adjusted also in terms of the size of their effective surface. In the embodiment of the second control valve 22 shown in FIGS. 6 and 7, the second shut-off body region 204 is partially provided with a smaller outer diameter for this reason. The third shut-off body region 205 is in addition beveled at its end facing the valve outlet opening 221, whereby the shut-off body 200 in its close-position is contacting the self-positioning ring-shaped seal insert 217 of the third guide means part 214 formed in accordance with the first control valve 21 in a sealing manner along a circular contact line enclosing the valve opening. Adjoining this bevel is in centric arrangement a pistil-shaped part of the piston which is dimensioned in such a way that it projects from the valve outlet opening 221 in any position of the shut-off body 200 and the shape of which is configured in a known manner with a view to optimal utilization of the flow forces occurring at the valve operation and consequently to an improvement in the switching behavior of the second control valve 22. The shut-off body 200 of the second control valve 22 according to FIGS. 6 and 7 is biased in the direction of the valve outlet opening 221 by a mechanical retaining means 209 in the form of a cylindrical compression spring so that the second control valve 22 is closed in the depressurized state; the valve block 2 serves as an abutment for the spring in the inventive control device 1—as already mentioned in connection with the first control valve 21. For receiving the compression spring, the shut-off body 200 of the second control valve 22 has at its end associated with the valve control opening 219 a centric bore with a first diameter, which ends approximately in the region of the bevel between the first and second shut-off body region 203, 204. An adjoining region with a second diameter, which is slightly reduced compared to the first one, is for centering of the compression spring. The bore continues with a third diameter which is reduced compared to the second diameter and ends in the region of the beveled end of the third shut-off body region 205. Each of the first, second, and third diameter of the bore is selected in such a way that the shut-off body 200 has an approximately equal wall thickness along its entire length without jeopardizing its mechanical stability. The more reliable positioning of the retaining means 209 enabled that way and the weight saving cause an improvement of the dynamic switching behavior of the second control valve 22.

In FIG. 8 the circuit diagram of a further embodiment of the inventive control device 1 is depicted with a motor-driven pump 9, a reservoir 10, and a hydraulic drive, or rather, hydraulic cylinder 11, and a flow path 6 according to FIG. 1 in detail comprising the power conduit sections 601 to 609 for conducting a working fluid as shown. This embodiment represents an advantageous further embodiment of the control device according to FIG. 2. It differs from the latter in the kind of the flow connection between the control port—valve control opening 219 according to FIG. 5—of the first control valve 21 and the flow path 6 with otherwise matching features and allows an essentially load pressure-independent and delay-free closing of the first control valve 21. The details provided in connection with FIG. 2 are to be taken into account in this respect in addition to the following explanation of this further aspect of the invention. The flow connection between the control port—valve control opening 219 according to FIG. 5—of the first control valve 21 and the flow path 6 according to FIG. 1 is provided in the form of the second hydraulic control conduit 702 with the throttle element 611 in accordance with FIG. 2 which is connected to the second hydraulic power conduit 602 comprised in the flow path 6; a branch connection between this connection and the throttle element 611 establishes the working fluid flow to the inlet of the first pilot valve 31 of the pilot control means 3 through the third hydraulic control conduit 703. The second hydraulic power conduit 602 is connected via the check valve 612 to the third hydraulic power conduit 603 so that a volume flow of the working fluid is possible in the second hydraulic power conduit 602 in the first direction and in the third hydraulic power conduit 603 both in the first and in the second direction; although it is preferred, the check valve 612 for the restriction of the direction of the flow of the working fluid in the second hydraulic power conduit 602 of the inventive control device 1 according to FIG. 2 is not obligatory, it may yet be replaced for example by a suitable application of pressure to the working fluid by means of the motor-driven pump 9 too. The control port of the first control valve 21—valve control opening 219 in accordance with FIG. 5—in the control device 1 according to FIG. 2 thereby merely is connected to the flow path 6 for conducting the working fluid from the reservoir 10 to the hydraulic cylinder 11.

In the further embodiment of the control device 1 according to FIG. 8, however, the control port has a flow connection both with the second hydraulic power conduit 602 and with the third hydraulic power conduit 603 so that, consequently, not only the working fluid pressure within the flow path 6, or rather, in the power conduits 601, 602, 603, 604, and 605 for conducting the volume flow of the working fluid in the first direction from the reservoir 10 to the hydraulic cylinder 11 acts on the control port—valve control opening 219 according to FIG. 5—of the first control valve 21, but also the working fluid pressure prevailing in the power conduits 605, 604, 603, 608, and 609 for conducting the volume flow of the working fluid in the second direction from the hydraulic cylinder 11 to the reservoir 10. This configuration of the hydraulic circuit ensures therefore the load-pressure-dependent pre-positioning of the piston—shut-off body 200 according to FIG. 5—of the first control valve 21 and the load-pressure-compensated adjustment of the operating point of the latter respectively.

The flow connection of the control port—valve control opening 219 according to FIG. 5—of the first control valve 21 to the second hydraulic power conduit 602 takes place by means of a tenth hydraulic control conduit 710, which has a throttle element 611 and a filter 614 in a serial arrangement. The throttle element 611 is configured in such a way that an undesirable abrupt opening of the first control valve 21 at a corresponding increase in the working fluid pressure in the second hydraulic power conduit 602 is prevented by a defined attenuation of the volume flow of the working fluid directed away from the control port. With the filter 614, potential impurities in the working fluid, such as solid particles, are in particular kept away from the throttle element, hence potential switching malfunction of the first control valve 21 by such impurities is prevented; as the throttling effect of the filter 614 is negligible as against that of the throttle element 611, the tenth hydraulic control conduit 710 in this respect essentially corresponds to the second hydraulic control conduit 702 of the embodiment of the control device 1 according to FIG. 2.

From the tenth hydraulic control conduit 710 branches off in the region between the filter 614 and the throttle element 611 an eleventh hydraulic control conduit 711, which in its turn is connected to the control port—valve control opening 219 according to FIG. 5—of the first control valve 21 through a spring-loaded check valve 612 in the forward direction. This check valve 612 thus controls the volume flow of the working fluid from the second hydraulic power conduit 602 via the tenth and eleventh hydraulic control conduit 710, 711 to the control port of the first control valve 21 through the defined retaining force of the return spring comprised in it, while it prevents a corresponding volume flow in the opposite flow direction. The flow connection of the control port to the third hydraulic power conduit 603 for the load-pressure-dependent pre-positioning of the piston—shut-off body 200 according to FIG. 5—of the first control valve 21 is provided in the form of a twelfth hydraulic control conduit 712 having a hydro-mechanical transmission means 615 of a conventional design at its end associated with the first control valve 21 with a spring-loaded, hydraulically actuatable plunger. The hydro-mechanical transmission means 615 converts through a longitudinal movement, or rather, an outward movement of its plunger the working fluid pressure generated by the hydraulic cylinder 11 as a function of the particular pay load at a standstill or during its lowering into a proportional travel signal; the working fluid pressure prevailing in the fifth, fourth, and third hydraulic power conduit 605, 604, 603, or in the flow path 6 according to FIG. 1 for conducting the volume flow of the working fluid in the second direction, is exerted to the hydraulic port of the hydro-mechanical transmission means 615 via the twelfth hydraulic control conduit 712.

Its plunger and the piston of the first control valve 21—the first shut-off body part 201 of the shut-off body 200 according to FIG. 5—are axially aligned for centric co-operation in each case (cf. FIG. 9) and are coupled to each other free of play due to the retaining force of the cylindrical compression spring—retaining means 209 according to FIG. 5—of the first control valve 21. Thereby an optimal force transmission between the hydro-mechanical transmission means 615 and the first control valve 21 is ensured and it is guaranteed that an increase of the working fluid pressure at the hydraulic port of the hydro-mechanical transmission means 615 effectuates a proportional longitudinal displacement of the piston, or rather, of the first shut-off body part 201 in the direction of the second shut-off body part 202 of the shut-off body 200 in its design as two-part differential piston according to FIG. 5 and therefore allows for a load-pressure-dependent pre-positioning of the shut-off body 200. The operating displacement of the plunger in the embodiment of the first control valve 21 according to FIG. 5 is determined in this respect by the pay load acting on the hydraulic cylinder 11, and the spring constants of the retaining means 209 and particularly of the hydro-mechanical transmission means 615, and by the maximum operating displacement of the shut-off body 200 and is sized so that it does not exceed half of the maximum operating displacement of the shut-off body 200. This load-pressure-dependent pre-positioning of the shut-off body 200 may thus be carried out with simultaneous flow of working fluid into the first control valve 21 via the eleventh hydraulic control conduit 711 through a synchronization of the actuations of the hydro-mechanical transmission means 615 and the check valve 612 by a suitable adjustment of the spring constants of the two return springs so that an undesirable formation of vacuum, or of negative pressure, due to an actuation of the piston in the region of the valve control opening 219, more precisely within the first guide means part 210 of the first control valve 21 according to FIG. 5 can be ruled out. The further embodiment of the inventive control device 1 according to FIG. 8 enables therefore via the twelfth hydraulic control conduit 712 a load-pressure-dependent dynamic adjustment of the operating displacement of the piston, or rather, shut-off body 200 of the first control valve 21 according to FIG. 5 between the open- and the close-position. In conjunction with the essentially undamped flow of the working fluid to the control port, i.e. valve inlet opening 219, via the eleventh hydraulic control conduit 711, thus in bypassing of the tenth hydraulic control conduit 710 with the throttle element 611, results from this a largely load-independent shortening of the dead time at closing of the first control valve 21. This more rapid closing in turn causes a more rapid opening of the check valve 612 in the flow path 6 in a hydraulic drive system 16 according to FIG. 1 and, finally, a more rapid extension stroke of the piston of the hydraulic drive provided as a hydraulic cylinder 11. In a hydraulic drive system for an elevator, the inventive control device 1 in this embodiment thereby facilitates in particular a faster start-up and thus an improvement of the starting quality of the elevator.

Figure 9:
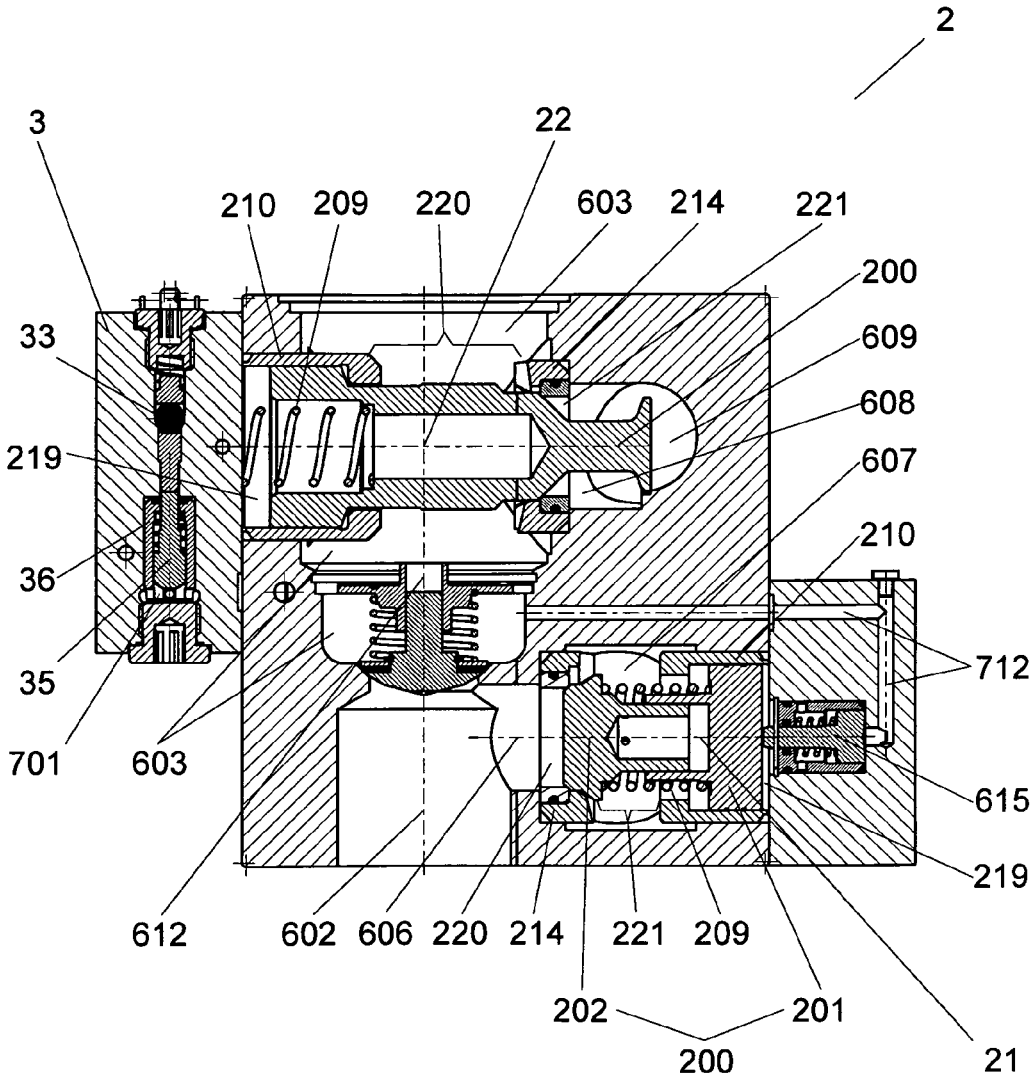
FIG. 9 is a sectional view of a valve block in structural design as a detail of a control device in accordance with FIG. 8.

FIG. 9, finally, is a sectional view of a structural embodiment of the valve block 2 according to the circuit diagram of the control device 1 depicted in FIG. 8. The valve block 2 is formed with a housing made by metal casting as cuboid having openings molded therein and six rectangular boundary surfaces and comprises as a functional unit in a releasable connection in each case the pilot control means 3 in the form of a pilot control block corresponding to FIG. 3, and a transmission means block with the hydro-mechanical transmission means 615, and the throttle element 611, the check valve 612, and the filter 614. Extending between the base and the boundary surface congruent with it, or rather, top surface of the housing are the portion of the second hydraulic power conduit 602 running within the inventive control device 1 and the third hydraulic power conduit 603 with the check valve 612 arranged in the direction of flow in between; the latter prevents in this respect a volume flow of the working fluid through the second hydraulic power conduit 602 in the second direction. For the leak-proof connection of the further portion of the second hydraulic power conduit 602 extending between the inventive control device 1 and the motor-driven pump 9 according to FIG. 8, the base of the housing of the valve block 2 has threaded holes to enable a respective screw connection. Such screw holes are also provided in the top surface of the housing of the valve block 2, in order to secure the flow measuring means 610 provided according to FIG. 8 in a leak-proof manner thereto, to produce a flow connection with the third hydraulic power conduit 603.

In the third hydraulic power conduit 603 the second control valve 22 in the embodiment according to FIG. 7 extends from the boundary surface adjacent to the base toward the boundary surface congruent with it, or rather, side surface of the housing, wherein the valve control opening 219 is assigned to the side surface, consequently the movement of the shut-off body 200 takes place orthogonal to the direction of the volume flow of the working fluid through the valve block 2 and against the retaining force of the retaining means 209 formed as a cylindrical compression spring. In the side surface of the housing of the valve block 2 comprising the valve control opening 219, threaded holes are provided on which the pilot control means 3 is screwed abutting in a leak-proof manner on the side surface of the housing in the area around the bore which serves as a valve seat for the second control valve 22. In connection with the depth of the bore adapted to the axial length of the guide means, the pilot control means 3 in this way limits the axial movability of the shut-off body 200 of the second control valve 22 and so ensures its defined position within the valve block 2. In addition, the pilot control means 3 forms the abutment for the retaining means 209 of the second control valve 22 and thus enables a reliable sealing of the valve outlet opening 221 in the rest position of the shut-off body 200.

From the congruent side surface of the housing extends the first control valve 21 in the embodiment according to FIG. 5, the valve control opening 219 of which is assigned to this side surface, in the direction of the second hydraulic power conduit 602 and in flow connection with it via the sixth hydraulic power conduit 606. The movement of the first and second shut-off body part 201, 201 of the shut-off body 200 insofar also takes place orthogonal to the direction of the volume flow of the working fluid through the valve block 2 and against the retaining force of the retaining means 209 provided as a cylindrical compression spring. The side surface of the housing of the valve block 2 comprising the first control valve 21 is corresponding to the side surface with the second control valve 22 congruent to it in the area around the valve seat provided with threaded holes on which the transmission means block with hydro-mechanical transmission means 615, throttle element 611, check valve 612, and filter 614 in the same manner as the pilot control means 3 leak-proof is bolted to the housing of the valve block 2. The transmission means block as the pilot control means 3 is formed with a metallic housing in rectangular shape. This has a blind bore in its boundary surface facing the valve block 2 in which the hydro-mechanical transmission means 615 is mounted with its plunger aligned toward the valve block 2 and a receiving bore for each of the throttle element 611, the check valve 612, and the filter 614. In this respect, the bolted assembly also ensures a coupling free of play, in each case central between the end faces of the first shut-off body part 201 and the plunger in communication with the opposing retaining forces of the retaining means 209 of the first control valve 21 and the retaining means of the hydro-mechanical transmission means 615. The openings molded by casting in the housing of the valve block 2 constitute the segments of the flow path 6 for conducting the volume flow of the working fluid in the first and second direction comprised in the control device 1 according to FIG. 8, namely one segment of each of the second, third, seventh, and ninth hydraulic power conduit 602, 603, 607, 609 and the sixth and eighth hydraulic power conduit 606, 608.

The control conduits within the housing of the valve block 2, as well as the valve seats of the first and second control valve 21, 22, and the check valve 612 between the second and third hydraulic power conduit 602, 603 are carried out as bores. According to FIG. 8, the housing of the valve block 2 has in detail also a segment of each of the first, fifth to tenth, and twelfth hydraulic control conduit 701, 705, 706, 707, 708, 709, 710, 712 and the third and fourth hydraulic control conduit 703, 704. A further segment of each of the first, fifth, and sixth hydraulic control conduit 701, 705, 706 in the pilot control block, i.e. pilot control means 3, the eleventh hydraulic control conduit 711 and a further segment of each of the tenth and twelfth hydraulic control conduit 710, 712 in the transmission means block is each formed in the same manner and connected to the corresponding other segment in each case in a leak-proof manner by the specified particular bolted assembly; the flow connections provided in the form of bores are in each case carried out from the boundary surfaces of the particular block-shaped metal housing and closed in a conventional leak-proof manner by means of a casing expander there, where their continuation at the particular boundary surface of the metal block is not provided. The valve control block 2 is thanks to its modular configuration thus not only space-saving and cost-efficient in production, but is particularly distinguished by its ease of maintenance and corresponding low maintenance costs too.

LIST OF REFERENCE NUMERALS

1 control device
2 valve block
21 first control valve
22 second control valve
200 shut-off body
201-202 first to second shut-off body part
203-207 first to fifth shut-off body region
208 pressure equalization bore
209 retaining means
210 first guide means part
211 first guide means region
212 second guide means part
213 second guide means region
214 third guide means part
215 third guide means region
216 recess
217 seal insert
218 O-ring
219 valve control opening
220 valve inlet opening
221 valve outlet opening
3 pilot control means
31 first pilot valve
32 second pilot valve
33 coupling means
34 coupling region
35 impulse transmission means
36 impulse guiding means
4 electric actuating means
5 control unit
51 reference value-setting means
52 comparing means
53 controller
54 electric signal line
55 mechanical signal line
6 flow path
601-609 first to ninth hydraulic power conduit
610 flow measuring means
611 throttle element
612 check valve
613 stop valve
614 filter
615 hydro-mechanical transmission means
7 hydraulic control conduit
701-712 first to twelfth hydraulic control conduit
8 hydraulic safety conduit
81 hand pump
82 emergency discharge valve
9 motor-driven pump
10 reservoir
11 hydraulic drive
12 elevator car
13 position detecting means
14 elevator control unit
15 electric power line
16 hydraulic drive system

The invention claimed is:

1. A control device for a working fluid for the operation of a hydraulic drive comprising a flow path for conducting a volume flow of the working fluid in a first direction and in a second direction, a first control valve and a second control valve for controlling the volume flow in the flow path, a flow measuring device to detect the volume flow in the flow path, a comparator to compare the detected volume flow with a volume flow reference value which can be preset, and a pilot control to actuate the first control valve and the second control valve, wherein the flow path, the flow measuring device, the comparator, the pilot control, and the first control valve, and the second control valve form a control circuit for maintaining the volume flow of the working fluid in the flow path in dependence on the volume flow reference value, and the pilot control has a first pilot valve and a second pilot valve for controlling the first control valve and the second control valve, wherein the pilot control comprises an electric actuator to actuate and a coupler to couple each of the first pilot valve and of the second pilot valve, wherein said coupler is formed with a coupling region for moving to and fro between a first position and a second position, wherein in the first position the first pilot valve and the second pilot valve are coupled by the coupling region and can be actuated by the electric actuator so that the second control valve allows the volume flow of the working fluid in the flow path in the second direction, and wherein in the second position the first pilot valve and the second pilot valve are decoupled and only the first pilot valve can be actuated by the electric actuator so that the first control valve allows the volume flow of the working fluid in the flow path in the first direction.

2. The control device according to claim 1, wherein for moving the coupling region of the coupler to and fro between the first position and the second position an impulse generator for generating an impact momentum and an impulse guide with a first end and with a second end for guiding the impact momentum from the first end via the second end to the coupler are provided, wherein the impulse generator and the impulse guide are configured in a way that the coupling region of the coupler by an impact momentum on the coupler generated by the impulse generator and guided by the impulse guide is movable from its first position to its second position so that the coupling region of the coupler is decoupled from the first pilot valve and from the second pilot valve.

3. The control device according to claim 2, wherein the impulse guide comprises an impulse transmitter for the indirect mechanical transmission of an impact momentum generated by the impulse generator to the coupler, wherein the impulse transmitter and the impulse guide are configured for sliding co-operation in a way that the coupling region of the coupler is movable by an impact momentum generated by the impulse generator and transmitted by the impulse transmitter from the first end via the second end of the impulse guide to the coupler from its first position to its second position so that the coupling region of the coupler is decoupled from the first pilot valve and from the second pilot valve.

4. The control device according to claim 2, wherein the impulse guide at its first end has a hydraulic connecting area for the flow connection with the flow path so that the impact momentum for moving the coupling region of the coupler to and fro between the first position and the second position can be generated by the volume flow of the working fluid in the flow path, wherein the impulse generator is provided in the form of the working fluid.

5. The control device according to claim 1, wherein the coupling region of the coupler is encompassed by the surface of a spherical body.

6. The control device according to claim 1, wherein the electric actuator comprises one of an electro-magnetic actuator, a piezoelectric actuator, a stepping motor to actuate the first pilot valve and the second pilot valve.

7. The control device according to claim 1, wherein the first control valve and the second control valve each have a valve inlet opening, a valve outlet opening, and a valve control opening for the particular flow connection with the flow path, a shut-off body movable to and fro between an open-position and a close-position for controlling the volume flow of the working fluid in the flow path, a guide to guide the shut-off body between the open-position and the close-position, and a retainer to exert a retaining force on the shut-off body toward the close-position, wherein the guide and the shut-off body each are formed with a plurality of corresponding regions for sliding co-operation during the reciprocating motion of the shut-off body, wherein the guide in each case has in successive assembly a first guide part with a first guide region, a second guide part with a second guide region, and a third guide part with a third guide region in permanent joint in each case, wherein the first guide part and the third guide part are each formed for surrounding the particular corresponding part of the shut-off body and the second guide part in each case comprises a plurality of pins in parallel alignment with the direction of motion of the shut-off body so that the reciprocating movement of the shut-off body can take place relative to the guide under sliding co-operation with the first guide region and with the second guide region and sealing co-operation with the third guide region, wherein said second guide region comprises a part of the surface of at least one of the pins, and wherein the first guide part in each case constitutes the valve control opening, the second guide part constitutes the valve outlet opening of the first control valve and the valve inlet opening of the second control valve, and the third guide part constitutes the valve inlet opening of the first control valve and the valve outlet opening of the second control valve, and wherein the valve control opening of the first control valve and of the second control valve is configured in flow connection with the pilot control in each case so that the second control valve in the first position of the coupler allows the volume flow of the working fluid in the flow path in the second direction and the first control valve in the second position of the coupler allows the volume flow of the working fluid in the flow path in the first direction.

8. The control device according to claim 7, wherein the guide of the first control valve and of the second control valve is formed with an inner diameter being reduced or increased from the first guide part to the third guide part and the particular shut-off body in each case is formed with a corresponding first shut-off body region, second shut-off body region, and third shut-off body region in each case having a corresponding outer diameter in each case so that the reciprocating motion of the shut-off body of the first control valve and of the second control valve relative to the particular guide can be limited by the third guide part or by the first guide part.

9. The control device according to claim 7, wherein the third guide part of the first control valve and of the second control valve in each case has in its region adjacent to the second guide part at least one of (i) a plurality of recesses and/or (ii) a bevel so that the movement of the particular shut-off body within the third guide part enables a continuous change in the effective area of the valve inlet opening of the first control valve and of the valve outlet opening of the second control valve.

10. The control device according to claim 7, wherein the third guide part of the first control valve and of the second control valve has in its particular third guide region a self-positioning ring-shaped seal insert for a sealing co-operation with the particular shut-off body during closure of the valve inlet opening of the first control valve or of the valve outlet opening of the second control valve in a releasable connection in each case, wherein the seal insert is formed in a way that it contacts the third shut-off body region of the shut-off body in the close-position of the particular control valve along a circular contact line in a sealing manner.

11. The control device according to claim 7, wherein the shut-off body of the second control valve is formed one-part and can be biased by the retaining force of the retainer for co-operating with the guide in its direction of movement toward the third guide part so that the retaining force of the retainer counteracts a movement of the shut-off body from the close-position to the open-position.

12. The control device according to claim 11, wherein the second control valve is provided with its valve inlet opening and with its valve control opening in flow connection with the flow path for conducting the volume flow of the working fluid in the first direction and in the second direction and with its valve outlet opening with the flow path for conducting the volume flow of the working fluid in the second direction so that a reduction of pressure in the working fluid at the valve control opening enabled by the pilot control in the first position of the coupler via a movement of the shut-off body of the second control valve from its close-position to its open-position causes a volume flow of the working fluid in the flow path in the second direction.

13. The control device according to claim 11 wherein the shut-off body of the second control valve has a pistil-shaped projection at its end associated with the third guide part, wherein the pistil-shaped projection is formed in a way that the shut-off body is movable by a volume flow of the working fluid directed from the second valve opening to the third valve opening after the discharge of the working fluid from the third valve opening in the direction of the retaining force of the retainer.

14. The control device according to claim 7, wherein the shut-off body of the first control valve is formed at least two-part, with a first shut-off body part and with a second shut-off body part, wherein the first shut-off body part has the first shut-off body region and a fourth shut-off body region and the second shut-off body part has the second shut-off body region, and the third shut-off body region, and a fifth shut-off body region, wherein said fourth shut-off body region and said fifth shut-off body region are mounted slidably interlocking in a way that the length of the shut-off body is variable, and wherein the retainer is arranged such between the first shut-off body region and the second shut-off body region that in its rest position said fourth shut-off body region and said fifth shut-off body region overlap and the length of the shut-off body can be reduced by a displacement of the two shut-off body parts against the retaining force of the retainer.

15. The control device according to claim 14, wherein the retainer of the first control valve for co-operating with said first shut-off body part and said second shut-off body part of the shut-off body comprises a compression spring, wherein the compression spring is designed in a manner that in the rest position of the compression spring the length of the shut-off body can be reduced by an actuating force acting at the frontal outer surface of the first shut-off body part facing the valve control opening in the direction of the valve inlet opening and/or at the frontal outer surface of the second shut-off body part facing the valve inlet opening in the direction of the valve control opening in each case against the retaining force of the compression spring.

16. The control device according to claim 14, wherein the first control valve is provided with its valve inlet opening in flow connection with the flow path for conducting the volume flow of the working fluid in the first direction, with its valve outlet opening with the flow path for conducting the volume flow of the working fluid in the second direction, and with its valve control opening with the flow path for conducting the volume flow of the working fluid in the first direction and in the second direction, wherein the flow connection between the valve control opening and the flow path has in parallel arrangement a throttle element to damp the volume flow of the working fluid from the valve control opening, a check valve to conduct the working fluid to the valve control opening, and a hydro-mechanical transmitter to mechanically move the shut-off body at the valve control opening, and wherein the valve control opening furthermore is connected through the throttle element to the pilot control so that an increase in pressure in the working fluid at the valve control opening enabled by the pilot control in the second position of the coupler via a movement of the shut-off body of the first control valve from its open-position to its close-position causes a volume flow of the working fluid in the flow path in the first direction.

17. A hydraulic drive system for an elevator, comprising a reservoir with a working fluid, a motor-driven pump, a hydraulic drive, a control device, and a flow path which is provided between the reservoir, the control device, and the hydraulic drive in a way that the working fluid can be conducted from the reservoir via the pump and the control device to the hydraulic drive and from the latter back through the control device to the reservoir, wherein the control device is designed according to claim 1.

18. A method for retrofitting a hydraulic drive system for an elevator according to the preamble of claim 17, comprising a control device according to the preamble of claim 1, wherein the pilot control has a first pilot valve and a second pilot valve for controlling the particular first control valve and second control valve, and an electric actuator to actuate the first pilot valve, and a further electric actuator to actuate the second pilot valve, wherein in a process step a coupler with a coupling region for coupling the first pilot valve and the second pilot valve is mounted, wherein the coupler is formed with a coupling region for moving to and fro between a first position and a second position so that in the first position the first pilot valve and the second pilot valve are coupled by the coupling region and can be actuated by the electric actuator to enable the volume flow of the working fluid by the second control valve in the second direction in the flow path, and in the second position the first pilot valve and the second pilot valve are decoupled so that the first pilot valve can be actuated by the electric actuator to enable the volume flow of the working fluid by the first control valve in the first direction in the flow path.

19. The control device according to claim 9, wherein said recesses are formed at least in one of U-, V-, or Y-shape.

* * * * *